US006943501B2

(12) United States Patent
Kobayashi et al.

(10) Patent No.: US 6,943,501 B2
(45) Date of Patent: Sep. 13, 2005

(54) ELECTROLUMINESCENT DISPLAY APPARATUS AND DRIVING METHOD THEREOF

(75) Inventors: Yoshinao Kobayashi, Shiga (JP); Shinya Ono, Shiga (JP)

(73) Assignees: Chi Mei Optoelectronics Corp. (TW); Kyocera Corporation, Kyoto (JP)

( * ) Notice: Subject to any disclaimer, the term of this patent is extended or adjusted under 35 U.S.C. 154(b) by 0 days.

(21) Appl. No.: 10/715,851

(22) Filed: Nov. 19, 2003

(65) Prior Publication Data

US 2004/0100203 A1 May 27, 2004

(30) Foreign Application Priority Data

Nov. 21, 2002 (JP) ..... 2002-338525

(51) Int. Cl.[7] ..... G09G 3/10
(52) U.S. Cl. ..... 315/169.3; 345/76; 345/77
(58) Field of Search ..... 315/169.1, 169.3; 345/55, 60, 66–67, 76–77, 92

(56) References Cited

U.S. PATENT DOCUMENTS 5,684,365 A 11/1997 Tang et al. ..... 315/169.3
5,990,629 A * 11/1999 Yamada et al. ..... 315/169.3
6,501,466 B1 12/2002 Yamagishi et al. ..... 345/204
6,633,270 B2 * 10/2003 Hashimoto ..... 345/76
6,768,482 B2 * 7/2004 Asano et al. ..... 345/90
2002/0051690 A1 * 5/2002 Downey ..... 409/182
2002/0190924 A1 * 12/2002 Asano et al. ..... 345/55

FOREIGN PATENT DOCUMENTS

JP 8-234683 A 9/1996
JP 2689917 B2 8/1997
JP 2001-147659 A 5/2001
JP 2002-91377 A 3/2002

* cited by examiner

*Primary Examiner*—Thuy Vinh Tran
(74) *Attorney, Agent, or Firm*—Birch, Stewart, Kolasch & Birch

(57) ABSTRACT

A common line is eliminated, and one terminal of the capacitor, which has been heretofore connected to the common line, is connected to the scan line of another display cell adjacent to the display cell having the capacitor. A scan line driving circuit supplies to respective scan lines a stepped pulse formed of a voltage V1 and a voltage V2 sufficiently larger than the voltage V1. A data line driving circuit supplies to the respective data lines a voltage not smaller than the voltage V1 and not larger than a voltage V3 (but smaller than the voltage V2) as a data voltage.

26 Claims, 13 Drawing Sheets

ELECTROLUMINESCENT DISPLAY APPARATUS AND DRIVING METHOD THEREOF

BACKGROUND OF THE INVENTION

1) Field of the Invention

The present invention relates to an electroluminescent (EL) display apparatus in which self-luminescent elements such as organic light emitting diodes (OLEDs) and thin film transistors (TFTs) for driving the self-luminescent elements are arranged in a matrix, and the driving method thereof, and more specifically, relates to a voltage-write type EL display apparatus in which nonuniform luminance does not occur even in a large screen display apparatus, and the driving method thereof.

2) Description of the Related Art

The organic EL display apparatus using an OLED is recently attracting attention because of a wide angle of visibility, high contrast, and excellent visibility, as compared with a liquid crystal display apparatus using a liquid crystal device. Since the organic EL display apparatus does not require a backlight, a thin and light display can be realized, and hence it is also advantageous in view of power consumption. Further, the organic EL display apparatus has features such that the response speed is fast since direct current low-voltage driving is possible, it is strong against vibrations since the display apparatus is formed of solid, it has a wide operating temperature limit, and a flexible shape is possible.

A conventional organic EL display apparatus will be explained below, mainly about an active matrix panel. FIG. 13 indicates the active matrix panel and a driving circuit in the schematic configuration of the conventional organic EL display apparatus. In FIG. 13, in the active matrix panel 100, display cells 110 are arranged at each point of intersection of n scan lines $Y_1$ to $Y_n$ and m data lines $X_1$ to $X_m$, and the basic structure is similar to that of the active matrix type liquid crystal display apparatus.

The active matrix panel 100 includes, as the liquid crystal display apparatus, a scan line driving circuit 120 that supplies a scan line select voltage at a predetermined timing with respect to the n scan lines $Y_1$ to $Y_n$ and a data line driving circuit 130 that supplies a data voltage at a predetermined timing with respect to the m data lines $X_1$ to $X_m$. In FIG. 13, other types of circuit for driving the organic EL display apparatus are omitted.

In the active matrix panel 100, the point different from the liquid crystal display apparatus is that the respective display cells 110 include the OLED instead of the liquid crystal device. As the configuration of the display cell 110, a so-called voltage write type display cell is well known, which includes a select TFT, a drive TFT, a capacitor, and an OLED one each (for example, see Japanese Patent Application Laid-open Publication No. H8-234683, hereinafter, "first patent document").

One example of an equivalent circuit in the voltage write type display cell is such that, as shown in FIG. 13, the gate of the select TFT is connected to the scan line and the drain to the data line, and the gate of the drive TFT is connected to the source of the select TFT, and the source to a common line (in many cases, a ground line GND). The capacitor is connected between the source and gate of the drive TFT, and the anode side of the OLED is connected to a supply voltage line ($V_{dd}$ in the figure), with the cathode side thereof connected to the drain of the drive TFT.

The operation of the voltage write type display cell will be explained briefly. When the scan line select voltage is supplied from the scan line driving circuit 120 to the gate of the select TFT, the select TFT becomes the ON state, so that the data voltage supplied from the data line driving circuit 130 is applied to the gate of the drive TFT and the capacitor. As a result, the drive TFT becomes the ON state, and a current path from the cathode side of the OLED to the common line is formed. In other words, the OLED emits light by the current determined corresponding to the data voltage. On the other hand, the data voltage is stored in the capacitor.

The stored data voltage is supplied to the gate of the drive TFT due to the connection between the drive TFT and the capacitor. Therefore, even when the scan line select voltage is not supplied to the gate of the select TFT, that is, after the scan line driving circuit 120 has shifted to the selection of the next scan line, the OLED continues to emit light until the next scan line is selected by the scan line driving circuit 120. In other words, the OLED continues to emit light by the data voltage written in the capacitor. Hence, this type of display cell is referred to as the voltage write type.

The first patent document relates to the voltage write type organic EL display apparatus, and other than this, a current write type organic EL display apparatus that can solve the problem of nonuniform luminance described later has also been proposed (for example, see Japanese Patent Application Laid-open Publication No. 2001-147659 hereinafter, "second patent document").

However, the organic EL display apparatus adopting the voltage write type display cell has a problem in that nonuniform luminance occurs in realizing a large screen. It is known that this problem occurs because the properties of the drive TFT (for example, threshold voltage $V_{th}$) are different between the display cells, even on a normal-size screen. Various solutions with respect to the problem due to the difference in the drive TFT have been proposed, and hence further explanation is omitted here.

The occurrence of nonuniform luminance due to a large screen is not attributable to the difference in the drive TFT, but attributable to wiring resistance of the common line. This problem will be explained below. FIG. 14A illustrates a display cell line of the i-th line in the active matrix panel 100. As shown in FIG. 14A, in m display cells on the i-th line, the sources of the respective drive TFTs are all connected to the same common line 31. In other words, while all drive TFTs are in the ON state, the currents $i_1$ to $i_m$ flowing to the respective OLEDs flow to the same common line 31. The common line 31 is formed of a highly conductive material, but has wiring resistance more or less (resistance $R_1$ to $R_{m+1}$ in the figure), and when the length thereof becomes long with an increase of the screen size, a voltage drop due to the wiring resistance cannot be ignored.

Normally, since high definition is realized with an increase of the screen size, the number of the display cells in the line direction also increases. This means that the sum total of the current flowing into the common line 31 increases, which causes a further increase in the voltage drop due to the wiring resistance. Therefore, when the luminance of the active matrix panel 100 is made the highest, the current value flowing into the common line 31 becomes the largest. FIG. 14B explains a voltage drop in the common line. The common lines 31 are arranged, as shown in FIG. 13, for each line, and in parallel with the line direction, and the opposite terminals thereof are connected to a common power source. Since the common power source is a grounded potential in many cases, the current flowing into the common line 31 from the respective display cells is divided by a current value corresponding to the inflow position and directed to the opposite terminals of the common line 31. Therefore, when the wiring length of the common line 31 is designated as L, as shown in FIG. 14B, the potential at a position of 0.5L from one end of the common line 31 becomes maximum, taking into consideration that the wiring resistance is superimposed according to the position from the end of the common line 31. The maximum value $V_{max}$ is expressed by the following equations:

$$V_{\max} = \frac{1}{2} \cdot r \cdot i \cdot \left(\frac{m+1}{2}\right)^2 \quad [m\text{: odd number}]$$

$$V_{\max} = \frac{1}{2} \cdot r \cdot i \cdot \frac{m}{2} \cdot \left(\frac{m+2}{2}\right) \quad [m\text{: even number}]$$

where the current flowing to the respective OLEDs is designated as "i", and a resistance of the wiring resistance of the common line 31 corresponding to between the display cells is designated as "r".

In the organic EL display apparatus, since all OLEDs are made to emit light steadily, the current flows from the respective display cells to the common line 31, even immediately before writing a new data voltage in the capacitor in the display cell. In other words, even immediately before writing a data voltage, the potential of the common line 31 has a size corresponding to the position of the display cell in which the data voltage is written, that is, a size according to the potential distribution as shown in FIG. 14B. As seen from the configuration of the display cell shown in FIG. 14A, since one terminal of the capacitor is connected to the common line 31, the voltage written in the capacitor has a size based on the potential of the common line 31. In other words, even when the data having the same voltage value is input respectively to the display cells on the first row and the display cells on the m/2-th row, the voltage written in the capacitor in the respective display cells is different.

For example, even when a data voltage $V_{sig}$ is supplied to all data lines $X_i$ to $X_m$ from the data line driving circuit 130, the voltage $V_{sig}$ is written in the capacitor in the display cell located on the data line $X_i$ in FIGS. 14A and 14B, and a voltage $V_{sig}-V_{max}$ which is smaller than the voltage $V_{sig}$ is written in the capacitor in the display cell located on the data line $X_{0.5L}$. That is, the active matrix panel 100 becomes dark in the central portion, and brighter towards the edges. This is an important problem in realizing a large size and high luminance in the active matrix panel 100.

The second patent document discloses a current write type display cell, but in this current write type, it is necessary to provide a minute current of a precise value to the respective display cells. With an increase of the screen size, the current control becomes difficult. Further, the current write type display cell requires more (for example, four) TFTs than being required in the voltage write type display cell, in order to form the display cell, this causes problems in improving a numerical aperture of the display cell and in cost reduction.

SUMMARY OF THE INVENTION

It is an object of the present invention to at least solve the problems in the conventional technology.

An electroluminescent display apparatus according to one aspect of the present invention includes a plurality of display cells arrange in a matrix form in which a plurality of scan lines and a plurality of data line intersect, and a scan line driving circuit. Each of the display cells includes select transistor whose gate receives a select voltage from one of the scan lines; a drive transistor whose gate receives a data voltage from one of the data lines through the select transistor; a capacitor whose one terminal is connected to the gate of the drive transistor; and an electroluminescent element whose one terminal is connected to one of a source and a drain of the drive transistor. The scan line driving circuit supplies a stepped pulse as the select voltage to each of the scan lines, the stepped pulse being formed of a first voltage and second voltage larger than the first voltage. The other of the source and the drain of the drive transistor and other terminal of the capacitor are connected to a scan line next to the one of the scan lines.

An electroluminescent display apparatus according to other aspect of the present invention includes a plurality of display cells arranged in a matrix form in which a plurality of select scan lines and a plurality of data lines intersect, a plurality of write scan lines, and a scan line driving circuit. Each of the display cells includes a select transistor whose gate receives a select voltage from one of the select scan lines; a drive transistor whose gate receives a data voltage from one of the data lines through the select transistor; a capacitor whose one terminal is connected to the gate of the drive transistor; and an electroluminescent element whose one terminal is connected to one of a source and a drain of the drive transistor. Each of the write scan lines is arranged in a pair with each of the select scan lines and is connected to the other of the source and the drain of the drive transistor and other terminal of the capacitor. The scan line driving circuit supplies a scan line select voltage to each of the select scan lines, and supplies a write reference voltage to each of the write scan lines that is in a pair with the each of the select scan lines. The scan line driving circuit supplies the scan line select voltage and the write reference voltage at a voltage value and a timing such that a first phase, a second phase, and a third phase are sequentially repeated, the first phase indicates that the data voltage is written in the capacitor without allowing the electroluminescent element to emit light, the second phase indicates that a voltage stored in the capacitor is held without allowing the electroluminescent element to emit light, and the third phase indicates that light emission by the electroluminescent element is sustained until the next first phase depending on the voltage stored.

An electroluminescent display apparatus according to still another aspect of the present invention includes a plurality of display cells arranged in a matrix form in which a plurality of scan lines and a plurality of data lines intersect, a plurality of common lines, and a data line driving circuit. Each of the display cells includes a select transistor whose gate receives a select voltage from one of the scan lines; a drive transistor whose gate receives a data voltage from one of the data lines through the select transistor; a capacitor whose one terminal is connected to the gate of the drive transistor; and an electroluminescent element whose one terminal is connected to one of a source and a drain of the drive transistor. Each of the common lines is connected to the other of the source and the drain of the drive transistor and other terminal of the capacitor. The data line driving circuit calculates a voltage drop in the electroluminescent element at a position in a direction of each of the scan lines, based on the position in the direction with respect to the each of common lines and a wiring resistance between the display cells arranged on the each of common lines, and supplies a data voltage corrected based on the voltage drop to each of data lines.

A driving method according to still another aspect of the present invention includes driving an electroluminescent display apparatus. The electroluminescent display apparatus includes a plurality of display cells arranged in a matrix form in which a plurality of scan lines and a plurality of data lines intersect, each of the display cells including a select transistor whose gate receives a select voltage from one of the scan lines; a drive transistor whose gate receives a data voltage from one of the data lines through the select transistor; a capacitor whose one terminal is connected to the gate of the drive transistor; and an electroluminescent element whose one terminal is connected to one of a source and a drain of the drive transistor, wherein the other of the source and the drain of the drive transistor and other terminal of the capacitor are connected to a scan line next to the one of the scan lines. The driving method includes first supplying a first voltage to each of the scan lines during a predetermined cycle; second supplying a second voltage larger than the first voltage to the each of the scan lines during the cycle, successively from the first supplying; and third supplying a voltage not larger than a threshold voltage of the select transistor to each of the scan lines, at least during the cycle, successively from the second supplying.

A driving method according to still another aspect of the present invention includes driving an electroluminescent display apparatus. The electroluminescent display apparatus includes a plurality of display cells arranged in a matrix form in which a plurality of select scan lines and a plurality of data lines intersect, each of the display cells including a select transistor whose gate receives a select voltage from one of the select scan lines; a drive transistor whose gate receives a data voltage from one of the data lines through the select transistor; a capacitor whose one terminal is connected to the gate of the drive transistor; and an electroluminescent element whose one terminal is connected to one of a source and a drain of the drive transistor; and a plurality of write scan lines, each of the write scan lines being arranged in a pair with each of the select scan lines and being connected to the other of the source and the drain of the drive transistor and other terminal of the capacitor. The driving method includes first supplying the select voltage and a write reference voltage to each of the select scans line and each of the write scan lines, respectively, at a voltage value and a timing such that the data voltage is written in the capacitor, without allowing the electroluminescent element to emit light; second supplying the select voltage and the write reference voltage to the each of the select scan lines and the each of the write scan lines, respectively, at a voltage value and a timing such that a voltage stored in the capacitor is held, without allowing the electroluminescent device to emit light; and third supplying the select voltage and the write reference voltage to the each of the select scan lines and the each of the write scan lines, respectively, at a voltage value and a timing such that light emission of the electroluminescent device is sustained until the next first supplying, based on the voltage stored.

A driving method according to still another aspect of the present invention includes driving an electroluminescent display apparatus. The electroluminescent display apparatus includes a plurality of display cells arranged in a matrix form in which a plurality of scan lines and a plurality of data lines intersect, each of the display cells including a select transistor whose gate receives a select voltage from one of the scan lines; a drive transistor whose gate receives a data voltage from one of the data lines through the select transistor; a capacitor whose one terminal is connected to the gate of the drive transistor; and an electroluminescent element whose one terminal is connected to one of a source and a drain of the drive transistor; an a plurality of common lines, each of the common lines being connected to the other of the source and the drain of the drive transistor and the other terminal of the capacitor. The driving method includes calculating a voltage drop in the electroluminescent element at a position in a direction of each of the scan lines, based on the position in the direction with respect to the each of common lines and a wiring resistance between the display cells arranged on the each of common lines; correcting the data voltage based on the voltage drop; and supplying the data voltage corrected to each of the data lines.

The other objects, features and advantages of the present invention are specifically set forth in or will become apparent from the following detailed descriptions of the invention when read in conjunction with the accompanying drawings.

DETAILED DESCRIPTION

Exemplary embodiments of EL display apparatus and driving methods according to the present invention will be explained in detail, with reference to the accompanying drawings. However, the present invention is not limited to the embodiments.

The characteristic points of the EL display apparatus and the driving method thereof according to a first embodiment are that the common line is eliminated, and one terminal of the capacitor heretofore connected to the common line is connected to the scan line in another display cell adjacent to the display cell having the capacitor, and the voltage applied to the scan line is a stepped pulse.

Figure 1:
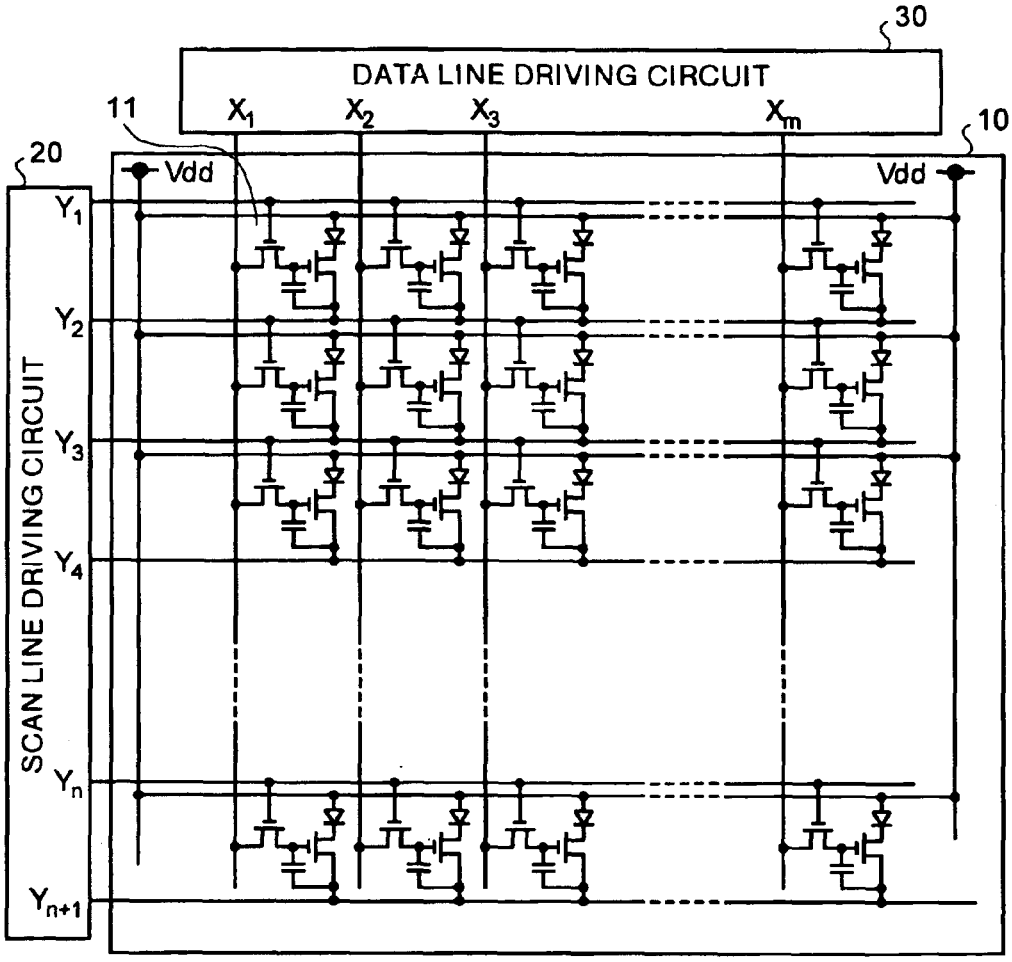
FIG. 1 is a schematic diagram of an EL display apparatus according to a first embodiment.

FIG. 1 illustrates an active matrix panel and a driving circuit in the schematic configuration of the EL display apparatus according to the first embodiment. In FIG. 1, in the active matrix panel 10, n scan lines $Y_1$ to $Y_n$ and m data lines $X_1$ to $X_m$ are formed in a lattice form on a glass substrate, and a display cell 11 is respectively arranged at each point of intersection of these scan lines and data lines. The respective display cells 11 include a TFT as described later. The active matrix panel 10 includes a scan line driving circuit 20 that supplies a scan line select voltage to the n scan lines $Y_1$ to $Y_n$ at a predetermined timing and a data line driving circuit 30 that supplies a data voltage to the m data lines $X_1$ to $X_m$ at a predetermined timing. That is, the configuration is the same as that of the conventional organic EL display apparatus shown in FIG. 13. In FIG. 1, other various types of circuit for driving the organic EL display apparatus are omitted.

Figure 13:
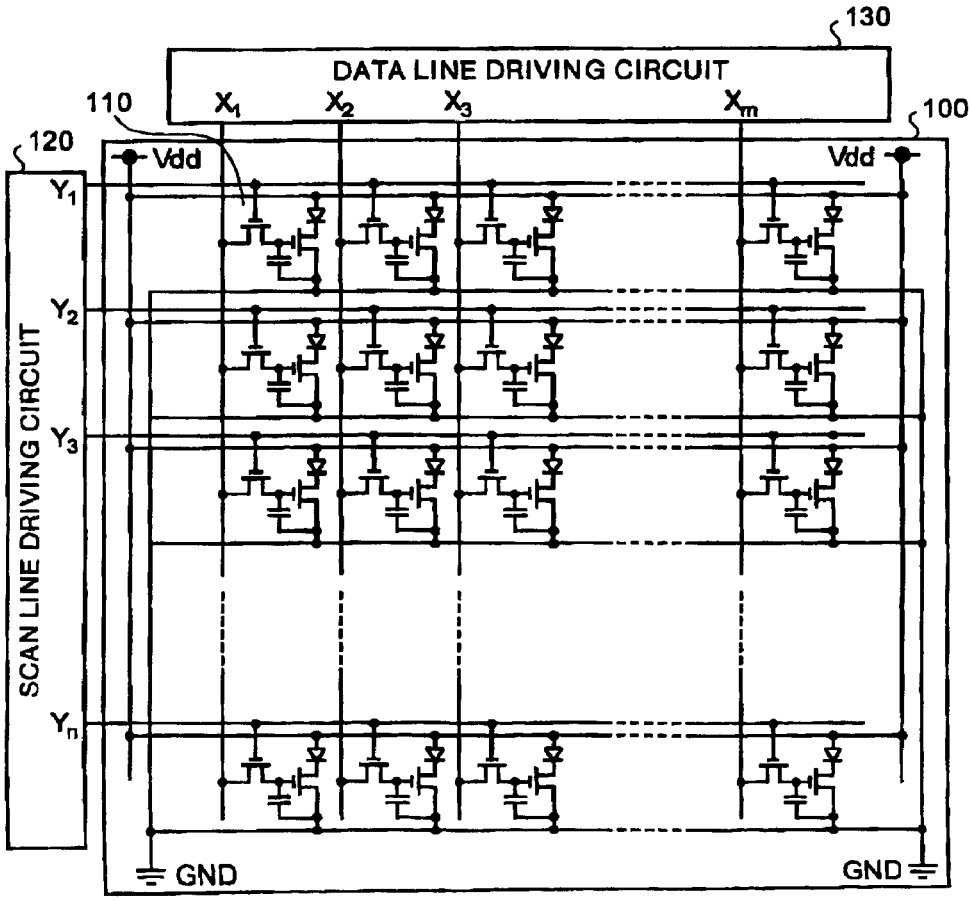
FIG.13 CONVENTIONAL ART
FIG. 13 is a schematic diagram of the conventional organic EL display apparatus.

In the EL display apparatus shown in FIG. 1, the points different from the conventional organic EL display apparatus shown in FIG. 13 are that the common line is eliminated, that one terminal of the capacitor in the respective display cells is connected to the scan line in the adjacent display cell, and that a supplementary scan line $Y_{n+1}$ connected to one terminal of the capacitor in the respective display cells on the n-th line (the last line) is provided. Further, a point that the scan line driving circuit 20 supplies a stepped pulse as the scan line select voltage, and a similar pulse to the supplementary scan line $Y_{n+1}$ is also different. That is, the driving method by the scan line driving circuit 20 is also the characteristic point of the present invention. The internally same pulse as that for the scan line $Y_1$ is supplied to the supplementary scan line $Y_{n+1}$ by the scan line driving circuit 20.

Figure 2:
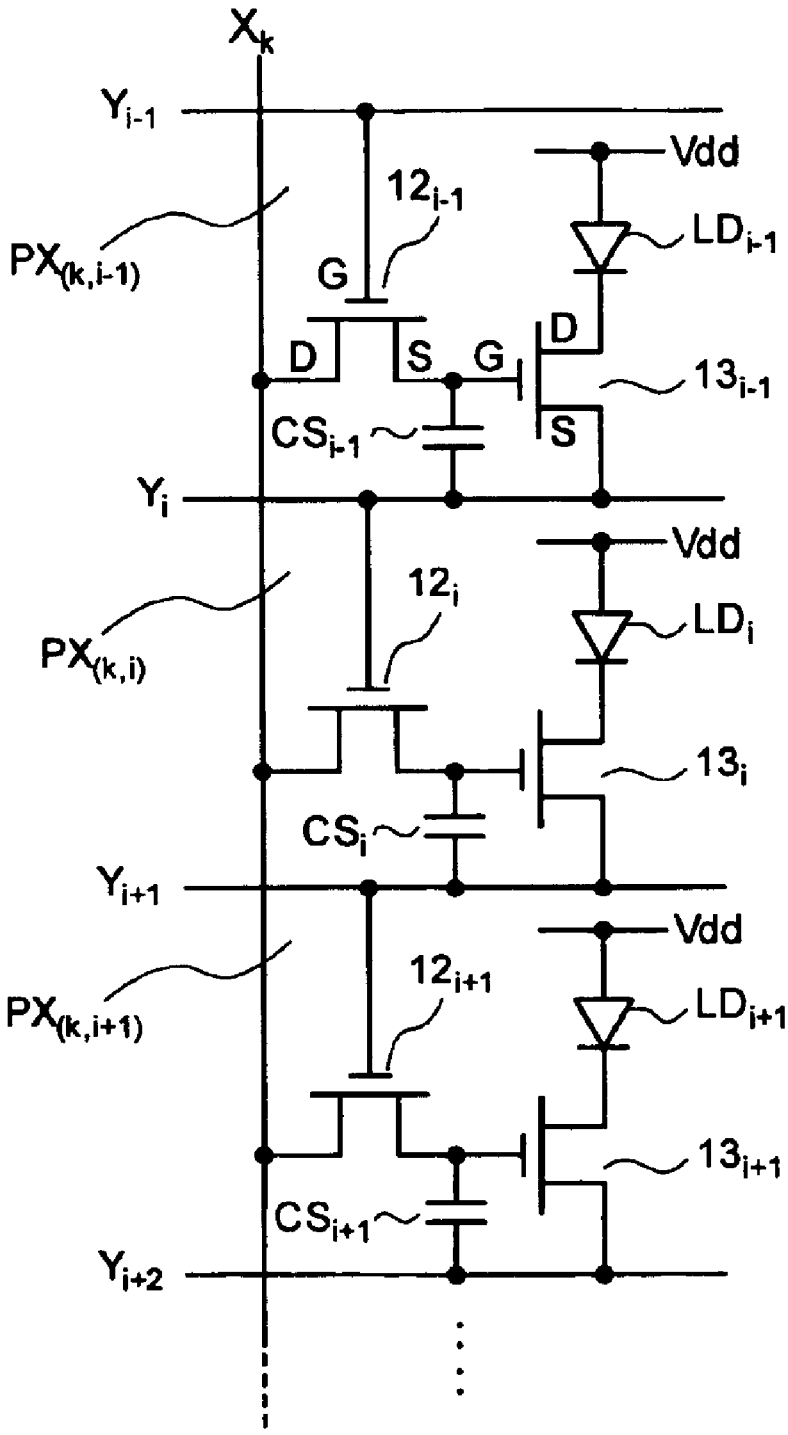
FIG. 2 is an equivalent circuit diagram in a display cell of the EL display apparatus according to the first embodiment.

FIG. 2 illustrates an equivalent circuit in the display cell of the EL display apparatus according to the first embodiment. FIG. 2 expresses three display cells $PX_{(k,\ i-1)}$, $PX_{(k,\ i)}$, $PX_{(k,\ i+1)}$ located on the i−1-th line to the i+1-th line on the k-th row. Here, the equivalent circuit in the display cell $PX_{(k,\ i)}$ on the i-th line on the k-th row will be explained. The display cell $PX_{(k,\ i)}$ includes an n-channel (or p-channel) select TFT $\mathbf{12}_i$ whose gate is connected to the scan line $Y_i$ and drain (or source) is connected to the data line $X_k$, an n-channel (or p-channel) drive TFT $\mathbf{13}_i$ whose gate is connected to the source (or drain) of the select TFT $\mathbf{12}_i$ and the source (or drain) is connected to the scan line $Y_{i+1}$ in the low-order display cell $PX_{(k,\ i+1)}$, a capacitor $CS_i$ connected between the source (or drain) and the gate of the drive TFT $\mathbf{13}_i$, and an OLED $LD_i$ whose anode side is connected to a supply line of the supply voltage $V_{dd}$ and cathode side is connected to the drain (or source) of the drive TFT $\mathbf{13}_i$. The display cells $PX_{(k,\ i-1)}$, $PX_{(k,\ i+1)}$ and other display cells are expressed by the same equivalent circuit as in the display cell $PX_{(k,\ i)}$.

Figure 3:
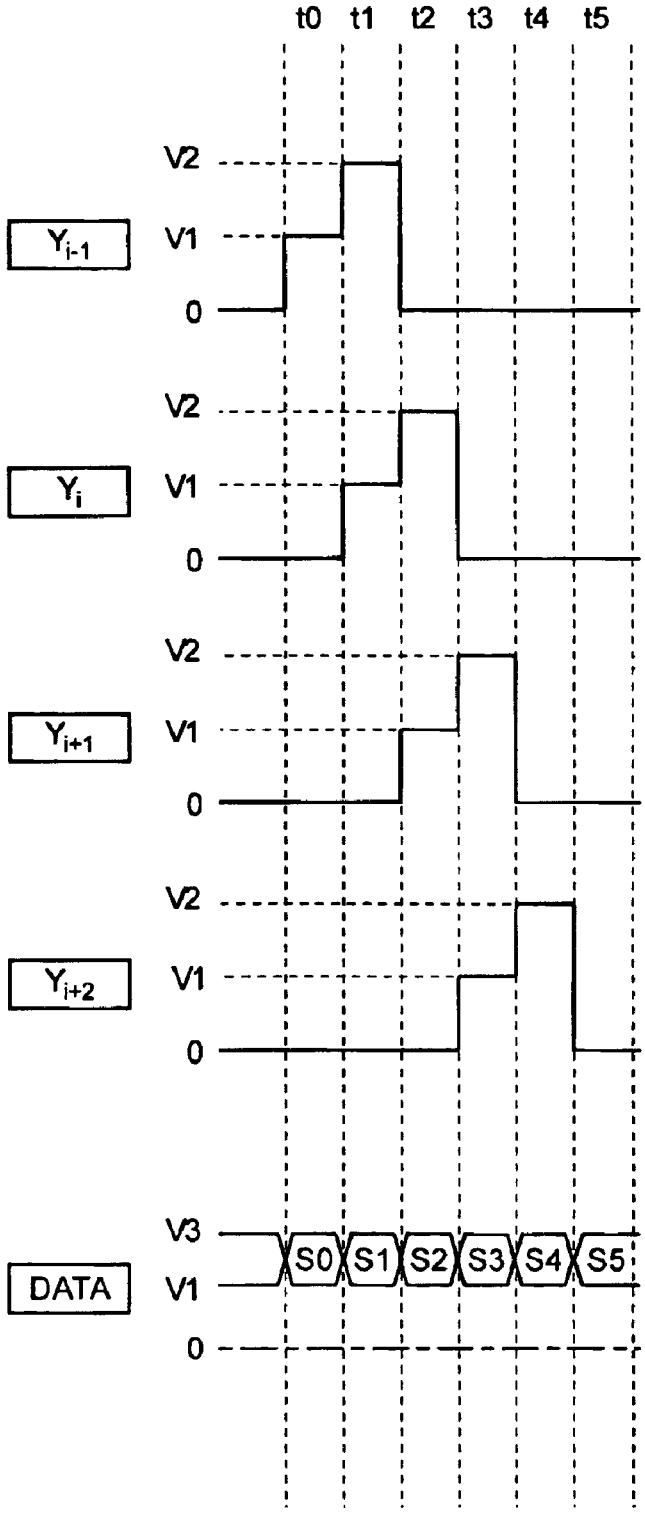
FIG. 3 is a timing chart of a scan line select voltage supplied to scan lines, and a data voltage supplied to a data line, in the equivalent circuit in the display cell in the EL display apparatus.

The operation of the equivalent circuit, assuming n-channel select and drive transistors 12 and 13, shown in FIG. 2 will be explained. FIG. 3 illustrates a timing chart of a scan line select voltage supplied to the scan lines $Y_{i-1}$ to $Y_{i+2}$, and a data voltage supplied to the data line $X_k$. In FIG. 3, voltage of the scan line $Y_{i+2}$ supplied to the display cell $PX_{(k,\ i+2)}$ is also shown, for the convenience of explanation.

First, during a period t0, the scan line driving circuit 20 supplies a voltage V1 to the scan line $Y_{i-1}$, and supplies a voltage not larger than a threshold voltage of the respective select TFTs (hereinafter, "0[V]" for the brevity of explanation) with respect to other scan lines (not shown). As a result, only the select TFT $\mathbf{12}_{i-1}$ in the display cell $PX_{(k,\ i-1)}$ becomes the ON state, and the other select TFTs are in the OFF state. The voltage V1 is expressed as:

$$V\mathbf{1}=V_{dd}-V_{th}.$$

Here, $V_{dd}$ is the supply voltage described above, and $V_{th}$ is a light-emitting threshold voltage of the OLEDs in the respective display cells.

During the period t0, a voltage S0 is supplied to the data line $X_k$ by the data line driving circuit 30. Since the source of the drive TFT $\mathbf{13}_{i-1}$ is connected to the scan line $Y_i$, the potential thereof indicates the potential of the scan line $Y_i$, that is, 0[V]. Therefore, when the select TFT $\mathbf{12}_{i-1}$ becomes the ON state, the source-gate voltage of the drive TFT $\mathbf{13}_{i-1}$, that is, a voltage S0 is input to the gate of the drive TFT $\mathbf{13}_{i-1}$. Since the voltage S0 indicates a positive value not smaller than the threshold voltage of the drive TFT $\mathbf{13}_{i-1}$, the drive TFT $\mathbf{13}_{i-1}$ becomes the ON state. When the drive TFT $\mathbf{13}_{i-1}$ becomes the ON state, a voltage obtained by subtracting the drain-source voltage of the drive TFT $\mathbf{13}_{i-1}$ from the supply voltage $V_{dd}$ is applied to the OLED $LD_{i-1}$. Since the drain-source voltage is sufficiently small, the OLED $LD_{i-1}$ is applied with a voltage not smaller than the light-emitting threshold and starts to emit light.

Further, since one terminal of the capacitor $CS_{i-1}$ is also connected to the scan line $Y_i$, the potential thereof indicates the potential of the scan line $Y_i$, that is, 0[V], during the period t0. Eventually, the potential difference between the data line $X_k$ and the scan line $Y_i$, that is, the voltage S0 is written in the capacitor $CS_{i-1}$. The data voltage supplied by the data line driving circuit 30 is not smaller than the voltage V1 and not larger than the voltage V3. That is, the voltage S0, voltages S1 to S5 described later, and voltages V1 and V3 have the following relationship:

$$\mathbf{V1}<\mathbf{S0}\text{ to }\mathbf{S5}<\mathbf{V3}.$$

On the other hand, the select TFTs in the display cells other than the display cell $PX_{(k,\ i-1)}$ become the OFF state during the period t0. Therefore, in the initial state in which electric charge is not held in the capacitors in these display cells, the respective drive TFTs are in the OFF state, and hence the respective OLEDs do not emit light.

During the next period t1, the scan line driving circuit 20 supplies a voltage V2 larger than the voltage V1 to the scan line $Y_{i-1}$, voltage V1 to the scan line $Y_i$, and 0[V] to scan lines $Y_{i+1}$ and $Y_{i+2}$, and other scan lines (not shown). As a result, the select TFT $\mathbf{12}_{i-1}$ in the display cell $PX_{(k,\ i-1)}$ and the select TFT $\mathbf{12}_i$ in the display cell $PX_{(k,\ i)}$ become the ON state, and the other select TFTs are in the OFF state. The voltage V2 is a sufficiently larger value than the voltage V3.

During the period t1, a voltage S1 is supplied to the data line $X_k$ by the data line driving circuit 30. Since the source of the drive TFT $\mathbf{13}_{i-1}$ is connected to the scan line $Y_i$, the potential thereof indicates the potential of the scan line $Y_i$, that is, V1. Therefore, when the select TFT $\mathbf{12}_{i-1}$ becomes the ON state due to the input of the voltage V2, the source-gate voltage of the drive TFT $\mathbf{13}_{i-1}$, that is, a voltage S1-V1 is input to the gate of the drive TFT $\mathbf{13}_{i-1}$. Since the voltage S1-V1 indicates a positive value not smaller than the threshold voltage of the drive TFT $13_{i-1}$, the drive TFT $13_{i-1}$ becomes the ON state.

When the drive TFT $13_{i-1}$ becomes the ON state, a voltage obtained by subtracting the drain-source voltage of the drive TFT $13_{i-1}$ and the voltage V1 from the supply voltage $V_{dd}$ is applied to the OLED $LD_{i-1}$. Since the drain-source voltage is sufficiently small, but the voltage V1 has the relation of $V1=V_{dd}-V_{th}$, the OLED $LD_{i-1}$ is applied with a voltage smaller than the light-emitting threshold and hence does not emit light. Further, since one terminal of the capacitor $CS_{i-1}$ is also connected to the scan line $Y_i$, the potential difference between the data line $X_k$ and the scan line $Y_i$, that is, the voltage S1-V1 is also written in the capacitor $CS_{i-1}$.

Further, since the source of the drive TFT $13_i$ is connected to the scan line $Y_{i+1}$, the potential thereof indicates the voltage of the scan line $Y_{i+1}$, that is, 0[V]. Therefore, when the select TFT $12_i$ becomes the ON state due to the input of the voltage V1, the source-gate voltage of the drive TFT $13_i$, that is, a voltage S1 is input to the gate of the drive TFT $13_i$. Since the voltage S1 indicates a positive value not smaller than the threshold voltage of the drive TFT $13_i$, the drive TFT $13_i$ becomes the ON state. When the drive TFT $13_i$ becomes the ON state, a voltage obtained by subtracting the drain-source voltage of the drive TFT $13_i$ from the supply voltage $V_{dd}$ is applied to the OLED $LD_i$, since the potential of the scan line $Y_{i+1}$ is 0[V]. This state is similar to that of the OLED $LD_{i-1}$ in the period t0, and hence the OLED $LD_i$ starts to emit light. Further, since the capacitor $CS_i$ is in the same state as that of the capacitor $CS_{i-1}$ during the period t0, the potential difference between the data line $X_k$ and the scan line $Y_i$, that is, the voltage S1 is written in the capacitor $CS_i$.

On the other hand, since the select TFTs in the display cells other than the display cell $PX_{(k,\ i-1)}$ and $PX_{(k,\ i)}$ become the OFF state during the period t1. Therefore, in the initial state in which electric charge is not held in the capacitors in these display cells, the respective drive TFTs are in the OFF state, and hence the respective OLEDs do not emit light.

During the next period t2, the scan line driving circuit 20 supplies voltage 0[V] to the scan line $Y_{i-1}$, voltage V2 to the scan line $Y_i$, voltage V1 to the scan line $Y_{i+1}$, and 0[V] to scan line $Y_{i+2}$, and other scan lines (not shown). As a result, the select TFT $12_i$ in the display cell $PX_{(k,\ i)}$ and the select TFT $12_{i+1}$, in the display cell $PX_{(k,\ i+1)}$ become the ON state, and the select TFT $12_{i-1}$ in the display cell $PX_{(k,\ i-1)}$ and the select TFTs in other display cells are in the OFF state. The voltage S2 is supplied to the data line $X_k$ by the data line driving circuit 30 during this period t2.

In this state, the select TFT $12_{i-1}$ in the display cell $PX_{(k,\ i-1)}$ is in the OFF state, but since voltage S1-V1 is written in the capacitor $CS_{i-1}$ in this display cell, the drive TFT $13_{i-1}$ becomes the ON state, with the voltage input to the gate thereof. However, since voltage V2 having a sufficiently large value is supplied to the scan line $Y_1$ connected to the source of the drive TFT $13_{i-1}$, the OLED $LD_{i-1}$ is applied with a voltage smaller than the light-emitting threshold, and hence it does not emit light.

On the other hand, since the source of the drive TFT $13_i$ is connected to the scan line $Y_{i+1}$, the potential thereof indicates the potential of the scan line $Y_{i+1}$, that is, V1, during the period t2. Therefore, when the select TFT $12_i$ becomes the ON state, the source-gate voltage of the drive TFT $13_i$, that is, a voltage S2-V1 is input to the gate of the drive TFT $13_i$. Further, since the source of the drive TFT $13_{i+1}$, is connected to the scan line $Y_{i+1}$, the potential thereof indicates the potential of the scan line $Y_{i+1}$, that is, 0[V], during the period t2. Therefore, when the select TFT $12_{i-1}$ becomes the ON state, the source-gate voltage of the drive TFT $13_{i+1}$, that is, a voltage S2 is input to the gate of the drive TFT $13_{i+1}$ and the capacitor $CS_{i+1}$.

The state of these display cells $PX_{(k,\ i)}$ and $PX_{(k,\ i+1)}$ is the same as that of the display cells $PX_{(k,\ i-1)}$ and $PX_{(k,\ i)}$ during the period t1. Therefore, the OLED $LD_i$ is applied with a voltage smaller than the light-emitting threshold, and hence it does not emit light, and the potential difference between the data line $X_k$ and the scan line $Y_i$, that is, a data voltage S2-V1 is written in the capacitor $CS_i$. Further, the OLED $LD_{i+1}$ starts to emit light, and the potential difference between the data line $X_k$ and the scan line $Y_i$, that is, data voltage S2 is written in the capacitor $CS_{i+1}$.

The select TFTs in the display cells other than those display cells are in the OFF state during the period t2. Therefore, in the initial state in which electric charge is not held in the capacitors in these display cells, the respective drive TFTs are in the OFF state, and hence the respective OLEDs do not emit light.

During period t3, the scan line driving circuit 20 supplies voltage 0[V] to the scan lines $Y_{i-1}$ and $Y_i$, voltage V2 to the scan line $Y_{i+1}$, voltage V1 to the scan line $Y_{i+2}$, and 0[V] to other scan lines (not shown). As a result, the select TFT $12_{i+1}$, in the display cell $PX_{(k,\ l+1)}$ and the select TFT $12_{i+2}$ in the display cell $PX_{(k,\ i+2)}$ become the ON state, and the select TFT $12_{i-1}$ in the display cell $PX_{(k,\ i-1)}$, the select TFT $12_i$ in the display cell $PX_{(k,\ i)}$, and the select TFTs in the other display cells are in the OFF state. The voltage S3 is supplied to the data line $X_k$ by the data line driving circuit 30 during this period t3.

In this state, the select TFT $12_{i-1}$ in the display cell $PX_{(k,\ i-1)}$ is in the OFF state, but since voltage S1-V1 is held in the capacitor $CS_{i-1}$ in this display cell, the drive TFT $13_{i-1}$ becomes the ON state, with the voltage input to the gate thereof. Further, since 0[v] is supplied to the scan line $Y_1$ connected to the source of the drive TFT $13_{i-1}$, the OLED $LD_i$ is applied with a voltage larger than the light-emitting threshold, and starts to emit light.

During this period t3, the select TFT $12_i$ in the display cell $PX_{(k,\ i)}$ is in the OFF state, but since the voltage S2-V1 is written in the capacitor $CS_i$ in this display cell in the period t2, the drive TFT $13_i$ becomes the ON state, with the voltage input to the gate thereof. However, since the voltage V2 is supplied to the scan line $Y_{i+1}$ connected to the source of the drive TFT $13_i$, the OLED $LD_i$ is applied with a voltage smaller than the light-emitting threshold, and hence does not emit light. In other words, the display cell $PX_{(k,\ i)}$ is in the same state as the display cell $PX_{(k,\ i-1)}$ in the period t2.

On the other hand, since the source of the drive TFT $13_{i+1}$ is connected to the scan line $Y_{i+2}$, the potential thereof indicates the potential of the scan line $Y_{i+2}$, that is, V1, during the period t3. Therefore, when the select TFT $12_{i+1}$ becomes the ON state, the source-gate voltage of the drive TFT $13_{i+1}$, that is, a voltage S3-V1 is input to the gate of the drive TFT $13_{i+1}$ and the capacitor $CS_{i+1}$.

This state is the same as that of the drive TFT $13_{i-1}$ in the period t1. Therefore, the OLED $LD_{i+1}$ is applied with a voltage smaller than the light-emitting threshold, and hence does not emit light, and the potential difference between the data line $X_k$ and the scan line $Y_i$, that is, the data voltage S3-V1 is written the capacitor $CS_{i+1}$.

The select TFTs in the display cells other than the display cell $PX_{(k,\ i+2)}$ are in the OFF state during the period t3. Therefore, in the initial state in which electric charge is not held in the capacitors in these display cells, the respective drive TFTs are in the OFF state, and hence the respective OLEDs do not emit light.

In the period t4 and onward, a stepped pulse as shown in FIG. 3, formed of voltages V1 and V2 is supplied to the respective display cells, in the order of selection by the scan line driving circuit 20, that is, in the order that the voltage V1 is supplied to the scan line as a scan line select voltage, thereby to repeat the operation described above.

In these operations, the respective display cells operate in a flow having a first phase for allowing the OLED to emit light momentarily based on the data voltage when voltage V1 is supplied to the scan line, a second phase for writing in the capacitor the data voltage when voltage V2 larger than voltage V1 is supplied to the scan line, without allowing the OLED to emit light, a third phase for holding the written voltage while stopping write in the capacitor, without allowing the OLED to emit light, and a fourth phase for sustaining the light emission of the OLED until the new first phase, based on the written voltage, while stopping write in the capacitor.

At the time of writing the voltage in the second phase, since the potential at one terminal of the capacitor connected to the common line in the conventional configuration is fixed to voltage V1, regardless of the position of the display cell, a desired voltage (data voltage−voltage V1) can be accurately written in the capacitor. However, it is necessary to supply to the data line a voltage larger by voltage V1 than the voltage to be written in the capacitor. Undesired light emission occurs in the first phase, but it is only for a quite short time that can be ignored as compared with the sustained light-emitting time in the fourth phase, and cannot be seen, and hence it does not cause any problem.

As explained above, according to the EL display apparatus and the driving method thereof according to the first embodiment, since one terminal of the capacitor and the source of the drive TFT are connected to the scan line for selecting a low-order line in the display cell including these, the common line that has been heretofore necessary can be eliminated. Further, the data voltage is written in the capacitor, with the potential at one terminal of the capacitor in the display cell fixed to voltage V1, which is input to the scan line, and with no current allowed to flow to the OLED. Therefore, the potential at one terminal of the capacitor does not change according to the position of the display cell on the line, and a desired voltage can be accurately held in the capacitor. In other words, even when the number of the display cells located in the line direction increases with an increase in the screen size of the active matrix panel 10, such nonuniform luminance, which has heretofore occurred, that it is dark in the central portion and brighter towards the edge does not occur.

The EL display apparatus and the driving method thereof according to a second embodiment will be explained below. The EL display apparatus and the driving method thereof according to the second embodiment has a feature in that in addition to the driving method explained in the first embodiment, a rectangular pulse equal to the pulse width of the stepped pulse is input to display cells other than the display cell in which the stepped pulse is written, to thereby perform data write and data erase at the same time on the same panel.

The schematic configuration of the EL display apparatus according to the second embodiment is as shown in FIG. 1, and hence the explanation thereof is omitted. Therefore, the driving method by the scan line driving circuit 20 will be explained below.

Figure 4:
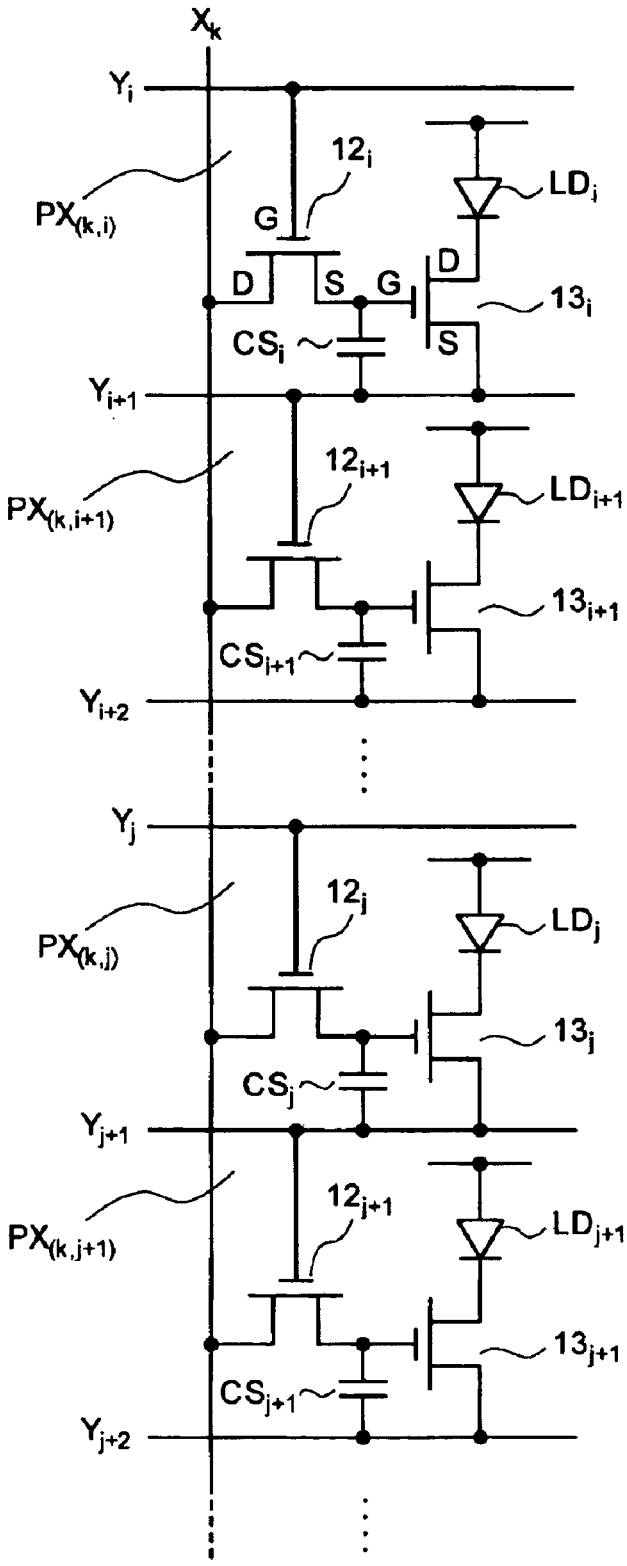
FIG. 4 is an equivalent circuit diagram in a display cell of an EL display apparatus according to a second embodiment.

FIG. 4 illustrates an equivalent circuit in a display cell of the EL display apparatus according to the second embodiment. Particularly, FIG. 4 indicates two display cells $PX_{(k,\ i)}$ and $PX_{(k,\ i+1)}$ located on the i-th line and the i+1-th line, and two display cells $PX_{(k,j)}$ and $PX_{(k,\ j+1)}$ located on the j-th line and the j+1-th line away from these two display cells by predetermined lines, on the k-th row. Since the circuit configuration and the signs in the respective display cells are the same as in the first embodiment, and hence the explanation thereof is omitted.

Figure 5:
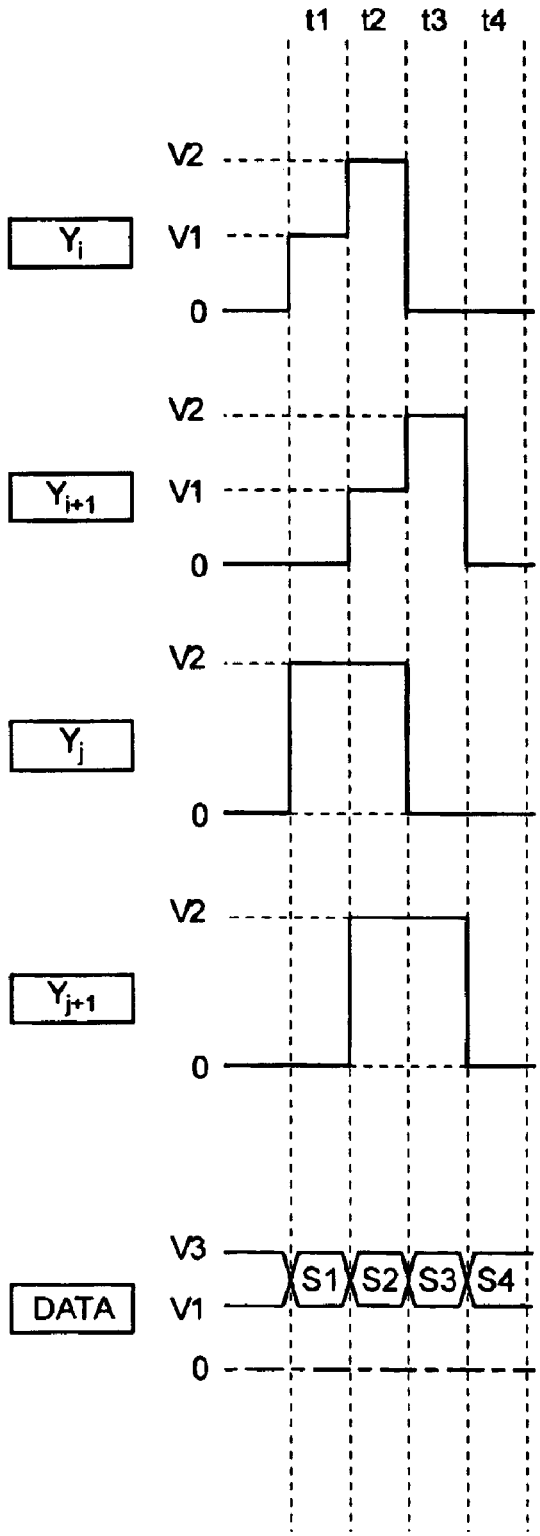
FIG. 5 is a timing chart of a scan line select voltage supplied to scan lines, and a data voltage supplied to a data line, in the equivalent circuit in the display cell in the EL display apparatus.

FIG. 5 illustrates a timing chart of a scan line select voltage supplied to the scan lines $Y_i$, $Y_{i+1}$, $Y_j$, and $Y_{j+1}$, and a data voltage supplied to the data line $X_k$, in the equivalent circuit shown in FIG. 4. Voltages V1, V2, and V3 in the figure have the relation shown in the first embodiment.

During the period t1, the scan line driving circuit 20 supplies voltage V1 to the scan line $Y_i$, voltage V2 to the scan line $Y_j$, and 0[V] to scan lines $Y_{i+1}$ and $Y_{j+1}$ and other scan lines (not shown). As a result, the select TFT $\mathbf{12}_i$ in the display cell $PX_{(k,\ i)}$ and the select TFT $\mathbf{12}_j$ in the display cell $PX_{(k,\ j)}$ become the ON state, and the other select TFTs are in the OFF state.

During the period t1, a data voltage S1 is supplied to the data line $X_k$ by the data line driving circuit 30. Since the source of the drive TFT $\mathbf{13}_i$ is connected to the scan line $Y_{i+1}$, the potential thereof indicates the potential of the scan line $Y_{i+1}$, that is, 0[V]. Therefore, when the select TFT $\mathbf{12}_i$ becomes the ON state, the source-gate voltage of the drive TFT $\mathbf{13}_i$, that is, the voltage S1 is input to the capacitor $CS_i$ and the gate of the drive TFT $\mathbf{13}_i$. This state is the same as that of the display cell $PX_{(k,\ i)}$ in the period t1 explained in the first embodiment. Therefore, the OLED $LD_i$ is applied with a voltage not smaller than the light-emitting threshold and starts to emit light, and a potential difference between the data line $X_k$ and the scan line $Y_{i+1}$, that is, voltage S1 is written in the capacitor $CS_i$.

Since the source of the drive TFT $\mathbf{13}_j$ is connected to the scan line $Y_{j+1}$, the potential thereof indicates the potential of the scan line $Y_{j+1}$, that is, 0[V]. Therefore, when the select TFT $\mathbf{12}_j$ becomes the ON state, the data voltage S1 is input to the capacitor $CS_j$ and the gate of the drive TFT $\mathbf{13}_j$. This state is also the same as that of the display cell $PX_{(k,\ i)}$. Therefore, the OLED $LD_j$ is applied with a voltage not smaller than the light-emitting threshold and starts to emit light, and a potential difference between the data line $X_k$ and the scan line $Y_{j+1}$, that is, data voltage S1 is written in the capacitor $CS_j$.

On the other hand, the select TFTs in the display cells other than the display cells $PX_{(k,\ i)}$, $PX_{(k,\ j)}$ are in the OFF state during the period t1. Therefore, in the initial state in which electric charge is not held in the capacitors in these display cells, the respective drive TFTs are in the OFF state, and hence the respective OLEDs do not emit light.

During the next period t2, the scan line driving circuit 20 supplies voltage V2 to the scan lines $Y_i$, $Y_j$, and $Y_{j+1}$, voltage V1 to the scan line $Y_{i+1}$, and 0[V] to other scan lines (not shown). As a result, the select TFT $\mathbf{12}_i$ in the display cell $PX_{(k,\ i)}$, the select TFT $\mathbf{12}_{i+1}$ in the display cell $PX_{(k,\ i+1)}$, the select TFT $\mathbf{12}_j$ in the display cell $PX_{(k,\ j)}$, and the select TFT $\mathbf{12}_{j+1}$ in the display cell $PX_{(k,\ j+1)}$ become the ON state, and other select TFTs are in the OFF state.

During this period t2, voltage S2 is supplied to the data line $X_k$ by the data line driving circuit 30. Since the source of the drive TFT $\mathbf{13}_i$ is connected to the scan line $Y_{i+1}$, the potential thereof indicates the potential of the scan line $Y_{i+1}$, that is, voltage V1. Therefore, when the select TFT $\mathbf{12}_i$ becomes the ON state, a voltage S2-V1 is input to the capacitor $CS_i$ and the gate of the drive TFT $\mathbf{13}_i$. Further, since the source of the drive TFT $\mathbf{13}_{i+1}$ is connected to the scan line $Y_{i+2}$, the potential thereof indicates the potential of the scan line $Y_{i+2}$, that is, 0[V]. Therefore, when the select TFT $12_{i+1}$ becomes the ON state, data voltage S2 is input to the capacitor $CS_{i+1}$ and the gate of the drive TFT $13_{i+1}$. The state of these display cells $PX_{(k, j)}$ and $PX_{(k, i+1)}$ is the same as that of the display cells $PX_{(k, j)}$ and $PX_{(k, i+1)}$ in the period t2 explained in the first embodiment. Therefore, the OLED $LD_i$ is applied with a voltage smaller than the light-emitting threshold and hence does not emit light, and a potential difference between the data line $X_k$ and the scan line $Y_{i+1}$, that is, data voltage S2-V1 is written in the capacitor $CS_i$. Further, the OLED $LD_{i+1}$ is applied with a voltage not smaller than the light-emitting threshold and starts to emit light, and a potential difference between the data line $X_k$ and the scan line $Y_{i+2}$, that is, data voltage S2 is written in the capacitor $CS_{i+1}$.

On the other hand, since the source of the drive TFT $13_j$ is connected to the scan line $Y_{j+1}$, the potential thereof indicates the potential of the scan line $Y_{j+1}$, that is, V2. Therefore, during the period t2, when the select TFT $12_j$ becomes the ON state, the source-gate voltage of the drive TFT $12_j$, that is, voltage S2-V2 is input to the gate of the drive TFT $13_j$. Since voltage V2 has a larger value than the data voltage, as explained in the first embodiment, the voltage S2-V2 indicates a negative value. That is, the drive TFT $13_j$ becomes the OFF state, and the OLED $LD_j$ does not emit light. Since one terminal of the capacitor $CS_j$ is also connected to the scan line $Y_{j+1}$, a potential difference between the data line $X_k$ and the scan line $Y_{j+1}$, that is, negative voltage S2-V2 is written in the capacitor $CS_j$.

Since the source of the drive TFT $13_{j+1}$ is connected to the scan line $Y_{j+2}$, the potential thereof indicates the potential of the scan line $Y_{j+2}$, that is, 0[V]. Therefore, when the select TFT $12_{j+1}$ becomes the ON state due to the input of voltage V2, the data voltage S2 is input to capacitor $CS_{j+1}$ and the gate of the drive TFT $13_{j+1}$. Since this state is also the same as that of the display cell $PX_{(k, i)}$ during the period t1 explained above. Therefore, the OLED $LD_{j+1}$ is applied with a voltage not smaller than the light-emitting threshold and starts to emit light, and a potential difference between the data line $X_k$ and the scan line $Y_{j+2}$, that is, data voltage S2 is written in the capacitor $CS_{j+1}$.

Further, the select TFTs in the display cells other than the display cells described above become the OFF state during this period t2. Therefore, in the initial state in which electric charge is not held in the capacitors in these display cells, the respective drive TFTs are in the OFF state, and hence the respective OLEDs do not emit light.

During the next period t3, the scan line driving circuit 20 supplies voltage V2 to the scan lines $Y_{i+1}$ and $Y_{j+1}$ and 0[V] to scan lines $Y_i$ and $Y_j$ and other scan lines (not shown). As a result, the select TFT $12_{i+1}$ in the display cell $PX_{(k, i+1)}$ and the select TFT $12_{j+1}$ in the display cell $PX_{(k, j+1)}$ become the ON state, and other select TFTs are in the OFF state.

During this period t3, voltage S3 is supplied to the data line $X_k$ by the data line driving circuit 30. In this state, the select TFT $12_i$ in the display cell $PX_{(k, i)}$ is in the OFF state, but since voltage S2-V1 has been written in the capacitor $CS_i$ in the same display cell in the period t2, the drive TFT $13_i$ becomes the ON state, with the voltage input to the gate thereof. However, since voltage V2 is supplied to the scan line $Y_i$ connected to the source of the drive TFT $13_i$, the OLED $LD_i$ is applied with a voltage smaller than the light-emitting threshold, and hence does not emit light, as in the state of the display cell $PX_{(k, i)}$ in the period t3 explained in the first embodiment.

Further, the source of the drive TFT $13_{i+1}$ is connected to the scan line $Y_{i+2}$, but the voltage shown in the timing chart of the scan line $Y_i$ in the periods t1 and t2 is sequentially provided with respect to the scan line $Y_{i+2}$ onward. Therefore, the potential at the source of the drive TFT $13_{i+1}$ indicates a potential of the scan line $Y_{i+2}$, that is, voltage V1. Accordingly, when the select TFT $12_{i+j}$ becomes the ON state, voltage S3-V1 is input to the capacitor $CS_{i+1}$ and the gate of the drive TFT $13_{i+1}$. The state of the display cell $PX_{(k, i+1)}$ is the same as that of the display cell $PX_{(k, i+1)}$ in the period t3 explained in the first embodiment. In other words, the OLED $LD_{i+1}$ is applied with a voltage smaller than the light-emitting threshold and does not emit light, and a potential difference between the data line $X_k$ and the scan line $Y_{i+2}$, that is, voltage S3-V1 is written in the capacitor $CS_{i+1}$.

On the other hand, the select TFT $12_j$ in the display cell $PX_{(k, j)}$ is in the OFF state, and since a negative voltage S2-V2 has been written in the capacitor $CS_i$ in this display cell in the period t2, the drive TFT $13_j$ becomes the OFF state as well. In other words, the OLED $LD_j$ does not emit light. Particularly, this non-light emission state is sustained until new voltage write is performed, as in the display cell $PX_{(k, i)}$ in the period t1. That is, data erase is performed with respect to the display cell $PX_{(k,j)}$.

Further, the source of the drive TFT $13_{j+1}$ is connected to the scan line $Y_{j+1}$, but the voltage shown in the timing chart of the scan line $Y_j$ in the periods t1 and t2 is sequentially provided with respect to the scan line $Y_{j+2}$ onward. Therefore, the potential at the source of the drive TFT $13_{j+1}$ indicates a potential of the scan line $Y_{j+2}$, that is, voltage V2. This state is the same as that of the display cell $PX_{(k, j)}$ in the period t2. In other words, the drive TFT $13_{j+1}$ becomes the OFF state, with negative voltage S3-V2 input to the gate, and the OLED $LD_{j+1}$ does not emit light, and a potential difference between the data line $X_k$ and the scan line $Y_{j+2}$, that is, a negative voltage S3-V2 is written in the capacitor $CS_{j+1}$.

Since the select TFTs in the display cells other than the display cells described above are in the OFF state in the period t3, in the initial state in which electric charge is not held in the capacitors in these display cells, the respective drive TFTs are in the OFF state, and hence the respective OLEDs do not emit light.

During the next period t4 and onward, the same operation as described above is repeated sequentially with respect the respective display cells. In other words, the respective display cells allow the OLEDs to emit light by accurate voltage write, in the order of supply of voltage V1 to the scan line by the scan line driving circuit 20, as the first stage of the stepped pulse. The respective display cells perform data erase in the order of supply of voltage V2, being rectangular pulse, to the scan line by the scan line driving circuit 20, as in the display cells $PX_{(k, j)}$ and $PX_{(k, j+1)}$.

As explained above, according to the EL display apparatus and the driving method thereof according to the second embodiment, in addition to the driving method explained in the first embodiment, a negative voltage is written sequentially to the capacitor in the display cell on the scan line, where voltage write for emitting light is not performed. Therefore, data display and data erase can be executed at the same time on the active matrix panel 10. Particularly, in the data erase operation, a reverse voltage is applied to between the source and gate of the drive TFT, thereby enabling suppression of a threshold voltage shift in the drive TFT.

The EL display apparatus and the driving method thereof according to a third embodiment will be explained below. The EL display apparatus and the driving method thereof according to the third embodiment has a feature in that a scan line connected to the select TFTs in the display cells on the same line (hereinafter, "select scan line") and a line connected to the capacitors in the display cells on the same line (hereinafter, "write scan line") are connected to the scan line driving circuit respectively independently, and a voltage pulse different to each other is applied to the select scan line and the write scan line at a predetermined timing.

Figure 6:
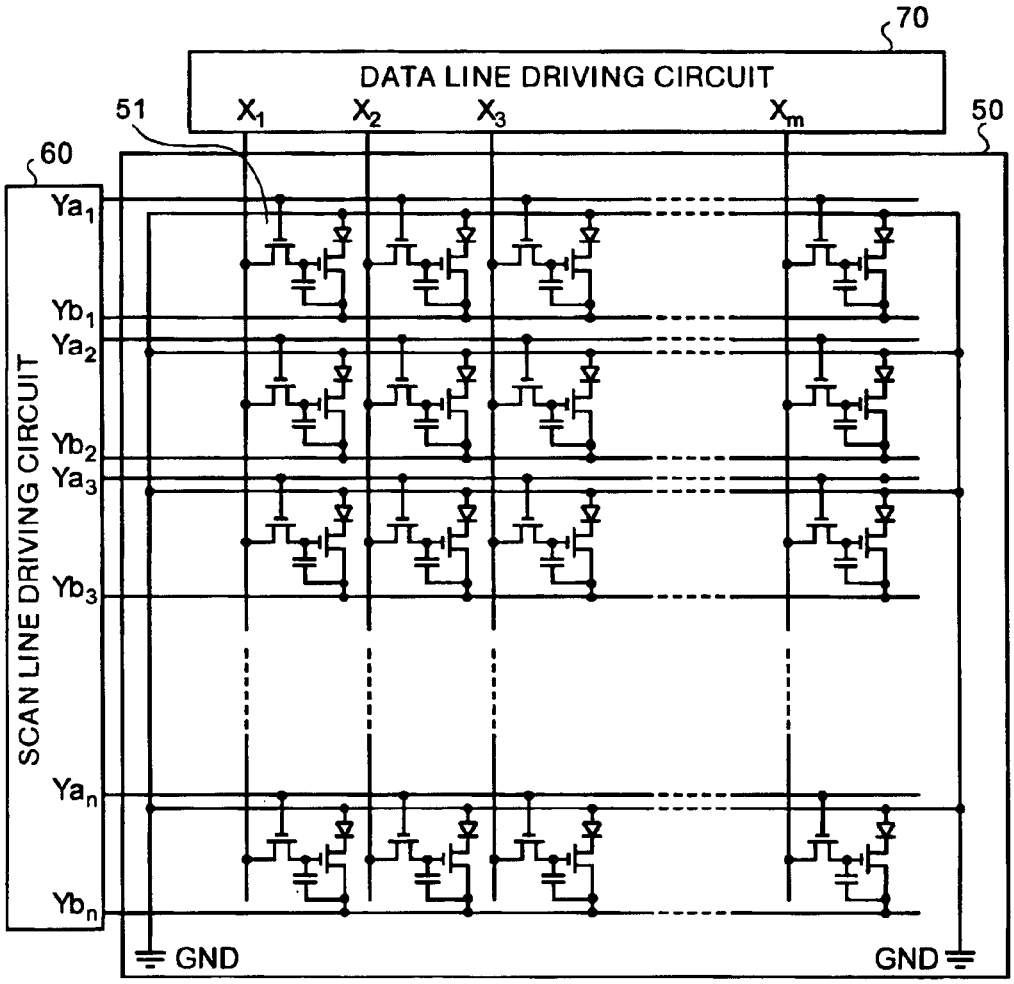
FIG. 6 is a schematic diagram of an EL display apparatus according to a third embodiment.

FIG. 6 illustrates an active matrix panel and a driving circuit in the schematic configuration of the EL display apparatus according to the third embodiment. In FIG. 6, in the active matrix panel 50, n select scan lines $Ya_1$ to $Ya_n$, n write scan lines $Yb_1$ to $Yb_n$, and m data lines $X_1$ to $X_m$ are formed in a lattice form on a glass substrate, and a display cell 51 is respectively arranged at each point of intersection of these select scan lines and data lines. The respective display cells 51 include a TFT as described later. The active matrix panel 50 includes a scan line driving circuit 60 that supplies a scan line select voltage to the n select scan lines $Ya_1$ to $Ya_n$ at a predetermined timing and supplies a write reference voltage to the n write scan lines $Yb_1$ to $Yb_n$ at a predetermined timing, and the data line driving circuit 30 that supplies a data voltage to the m data lines $X_1$ to $X_m$ at a predetermined timing. In FIG. 6, other various types of circuit for driving the organic EL display apparatus are omitted.

In the EL display apparatus shown in FIG. 6, the points different from the conventional organic EL display apparatus shown in FIG. 13 are that the common line heretofore connected to the capacitors in the respective display cells is connected to the scan line driving circuit 60, and that the anode side of the OLED in the respective display cells is connected to the ground line GND. Further, a point that the scan line driving circuit 60 supplies the scan line select voltage and the write reference voltage to the select scan line and the write scan line, respectively, in the state having a predetermined magnitude correlation is also different. That is, the driving method by the scan line driving circuit 50 is also characteristic.

Figure 7:
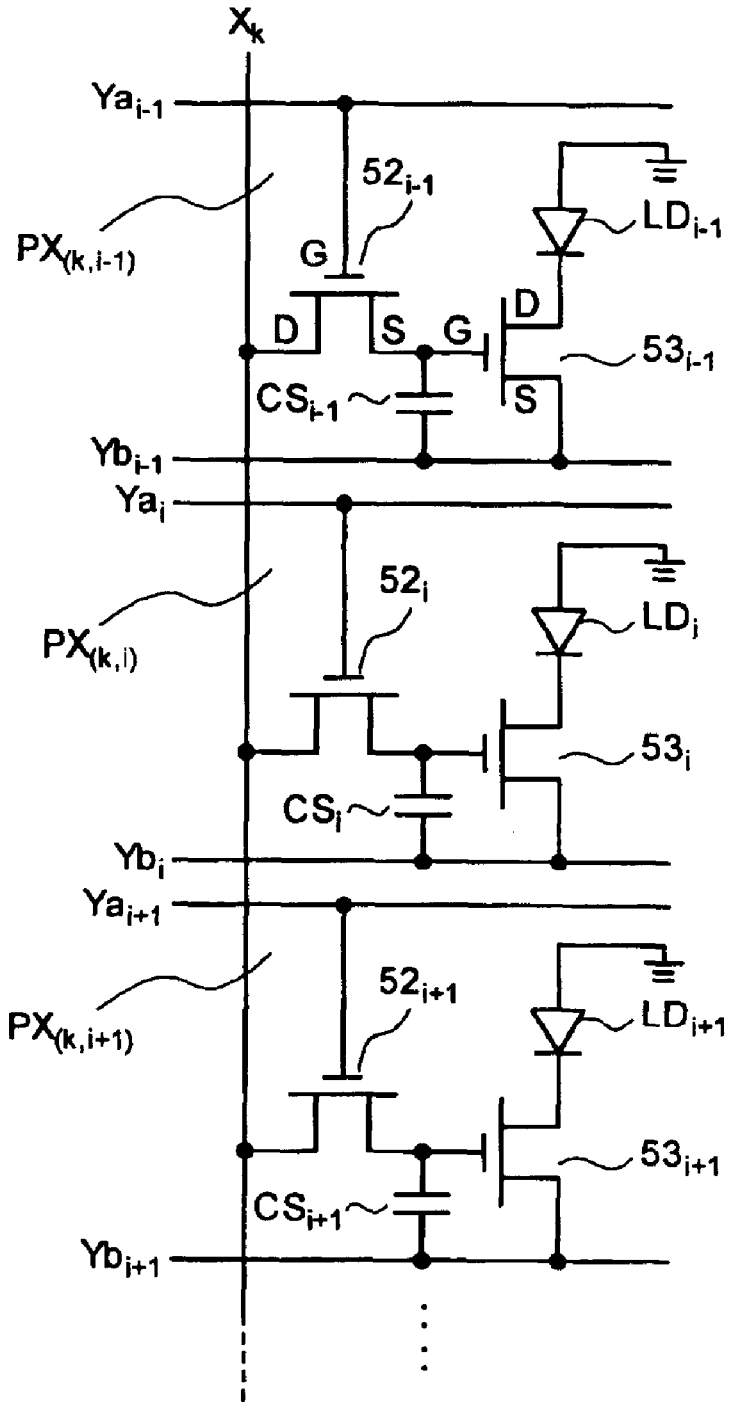
FIG. 7 is an equivalent circuit diagram in a display cell of the EL display apparatus according to the third embodiment.

FIG. 7 illustrates an equivalent circuit in the display cell of the EL display apparatus according to the third embodiment. FIG. 7 expresses three display cells $PX_{(k,\ i-1)}$, $PX_{(k,\ i)}$, $PX_{(k,\ i+1)}$ located on the i−1-th line to the i+1-th line on the k-th row. Here, the equivalent circuit in the display cell $PX_{(k,\ i)}$ on the i-th line on the k-th row will be explained. The display cell $PX_{(k,\ i)}$ includes an n-channel (or p-channel) select TFT $\mathbf{52}_i$ whose gate is connected to the scan line $Ya_i$ and drain (or source) is connected to the data line $X_k$, an n-channel (or p-channel) drive TFT $\mathbf{53}_i$ whose gate is connected to the source (or drain) of the select TFT $\mathbf{52}_i$ and the source (or drain) is connected to the scan line $Yb_i$, a capacitor $CS_i$ connected between the source (or drain) and the gate of the drive TFT $\mathbf{53}_i$, and an OLED $LD_i$ whose anode side is connected to the groundline GND and cathode side is connected to the drain (or source) of the drive TFT $\mathbf{53}_i$. The display cells $PX_{(k,\ i-1)}$, $PX_{(k,\ i+1)}$ and other display cells are expressed by the same equivalent circuit as in the display cell $PX_{(k,\ i)}$.

Figure 8:
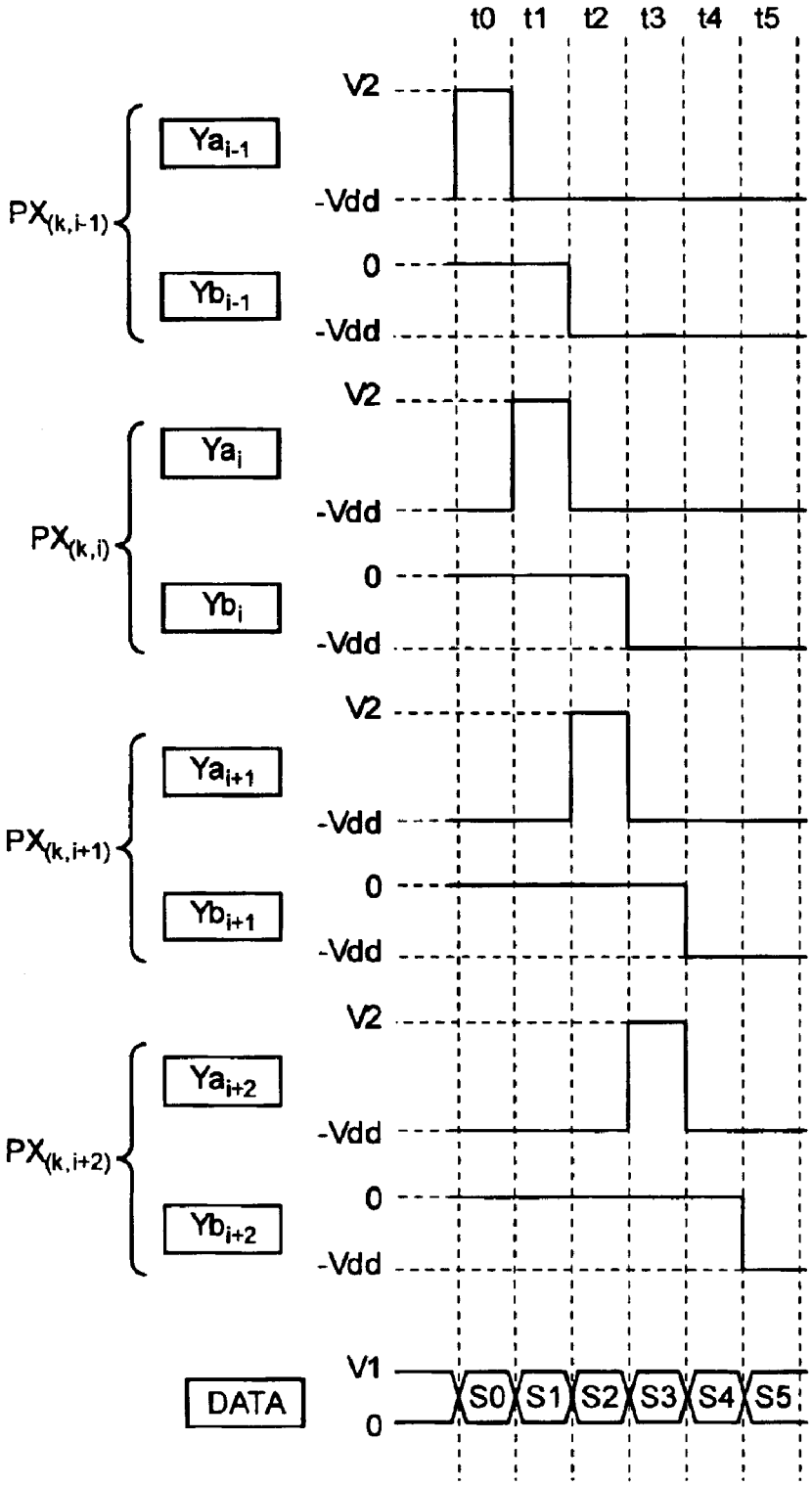
FIG. 8 is a timing chart of a scan line select voltage supplied to a select scan line, a write reference voltage supplied to a write scan line, and a data voltage supplied to a data line, in the equivalent circuit in the display cell in an EL display apparatus according to a fourth embodiment.

The operation of the equivalent circuit, assuming n-channel select and drive transistors, shown in FIG. 7 will be explained. FIG. 8 illustrates a timing chart of a scan line select voltage supplied to the scan lines $Ya_{i-1}$ to $Ya_{i+2}$, a write reference voltage supplied to the write scan lines $Yb_{i-1}$ to $Yb_{i+2}$, and a data voltage supplied to the data line $X_k$. In FIG. 8, voltage of the select scan line $Ya_{i+2}$ and voltage of the write scan line $Yb_{i+2}$ supplied to the display cell $PX_{(k,\ i+2)}$ are also shown, for the convenience of explanation.

At first, during the period t0, the scan line driving circuit 60 supplies a voltage V2 to the select scan line $Ya_{i-1}$, supplies a negative supply voltage $-V_{dd}$ to the select scan lines $Ya_i$ to $Ya_{i+2}$, and other select scan lines (not shown), and supplies grounded potential (0[V]) to the write scan lines $Yb_{i-1}$ to $Yb_{i+2}$ and other write scan lines (not shown). As a result, only the select TFT $\mathbf{52}_{i-1}$ in the display cell $PX_{(k,\ i-1)}$ becomes the ON state, and the other select TFTs are in the OFF state.

During the period t0, a voltage S0 is supplied to the data line $X_k$ by the data line driving circuit 70. Since the source of the drive TFT $\mathbf{53}_{i-1}$ is connected to the write scan line $Yb_{i-1}$, the potential thereof indicates the potential of the write scan line $Yb_{i-1}$, that is, 0[V]. Therefore, when the select TFT $\mathbf{52}_{i-1}$ becomes the ON state, the source-gate voltage of the drive TFT $\mathbf{53}_{i-1}$, that is, the voltage S0 is input to the gate of the drive TFT $\mathbf{53}_{i-1}$. The voltage S0 supplied by the data line driving circuit 70 and voltages S1 to S5 described later indicate a positive value not smaller than the threshold voltage of the drive TFT $\mathbf{53}_{i-1}$. That is, the drive TFT $\mathbf{53}_{i-1}$, becomes the ON state, with voltage S0 supplied to the gate, to form a current path between the cathode side of the OLED $LD_{i-1}$ and the write scan line $Yb_{i-1}$. However, since the write scan line $Yb_{i-1}$ indicates 0[V], voltage is not applied to the OLED $LD_{i-1}$, and hence the OLED $LD_{i-1}$ does not emit light.

In this state, since one terminal of the capacitor $CS_{i-1}$ is connected to the write scan line $Yb_{i-1}$, the potential thereof indicates the potential of the write scan line $Yb_{i-1}$, that is, 0[V], in the period t0. Eventually, a potential difference between the data line $X_k$ and the write scan line $Yb_{i-1}$, that is, voltage S0 is written in the capacitor $CS_{i-1}$. Particularly, at the time of writing the voltage, since current does not flow to the OLEDs in the display cells connected to the write scan line $Yb_{i-1}$, current does not flow into the write scan line $Yb_{i-1}$ from the respective OLEDs. This means that a voltage drop based on the position of the display cell, which has occurred in the conventional common line, does not occur.

On the other hand, since the select TFTs in the display cells other than the display cell $PX_{(k,\ i-1)}$ are in the OFF state in the period t0, in the initial state in which electric charge is not held in the capacitors in these display cells, the respective drive TFTs are in the OFF state, and hence the respective OLEDs do not emit light.

During the next period t1, the scan line driving circuit 60 supplies a voltage V2 to the select scan line $Ya_i$, a negative supply voltage $-V_{dd}$ to the select scan lines $Ya_{i-1}$, $Ya_{i+1}$, and $Ya_{i+2}$ and other select scan lines (not shown), and supplies grounded potential (0[V]) to the write scan lines $Yb_{i-1}$ to $Yb_{i+2}$ and other write scan lines (not shown). As a result, only the select TFT $\mathbf{52}_i$ in the display cell $PX_{(k,\ i)}$ becomes the ON state, and the other select TFTs are in the OFF state.

During the period t1, a voltage S1 is supplied to the data line $X_k$ by the data line driving circuit 70. Since the source of the drive TFT $\mathbf{53}_i$ is connected to the write scan line $Yb_i$, the potential thereof indicates the potential of the write scan line $Yb_i$, that is, 0[V]. Therefore, when the select TFT $\mathbf{52}_i$ becomes the ON state, the source-gate voltage of the drive TFT $\mathbf{53}_i$, that is, the voltage S1 is input to the gate of the drive TFT $\mathbf{53}_i$. This state is the same as the state in the display cell $PX_{(k,\ i-1)}$ in the period t0, and eventually, the drive TFT $\mathbf{53}_i$, with voltage S1 supplied to the gate, becomes the ON state, but voltage is not applied to the OLED $LD_i$, and hence the OLED $LD_i$ does not emit light.

In this state, a potential difference between the data line $X_k$ and the scan line $Yb_i$, that is, the voltage S1 is written in the capacitor $CS_i$, as in the capacitor $CS_{i-1}$ in the display cell $PX_{(k,\ i-1)}$ in the period t0. Even at the time of writing the voltage, since current does not flow into the write scan line $Yb_1$ from the OLEDs in the respective display cells, as explained above, a voltage drop does not occur.

On the other hand, since the select TFTs in the display cells other than the display cell $PX_{(k, i)}$ are in the OFF state in the period t1, in the initial state in which electric charge is not held in the capacitors in these display cells, the respective drive TFTs are in the OFF state, and hence the respective OLEDs do not emit light. Since the voltage S0 has been written in the capacitor $CS_{i-1}$ in the display cell $PX_{(k, i-1)}$ in the period t0, the drive TFT $\mathbf{53}_{i-1}$ becomes the ON state. However, since the write scan line $Yb_{i-1}$ indicates 0[V], a voltage is not applied to the OLED $LD_{i-1}$ and hence the OLED $LD_{i-1}$ does not emit light.

During the next period t2, the scan line driving circuit 60 supplies a voltage V2 to the select scan line $Ya_{i+1}$, a negative supply voltage $-V_{dd}$ to the select scan lines $Ya_{i-1}$, $Ya_i$, and $Ya_{i+2}$ and other select scan lines (not shown), and grounded potential (0[V]) to the write scan lines $Yb_{i-1}$ to $Yb_{i+2}$ and other write scan lines (not shown). As a result, only the select TFT $\mathbf{52}_{i+1}$ in the display cell $PX_{(k, i+1)}$ becomes the ON state, and the other select TFTs are in the OFF state.

During the period t2, a voltage S2 is supplied to the data line $X_k$ by the data line driving circuit 70. Since the source of the drive TFT $\mathbf{53}_{i+1}$ is connected to the write scan line $Yb_{i+1}$, the potential thereof indicates the potential of the write scan line $Yb_{i+1}$, that is, 0[V]. Therefore, when the select TFT $\mathbf{52}_{i+1}$ becomes the ON state, the source-gate voltage of the drive TFT $\mathbf{53}_{i+1}$, that is, the voltage S2 is input to the gate of the drive TFT $\mathbf{53}_{i+1}$. This state is the same as the state in the display cell $PX_{(k, i-1)}$ in the period t0, and eventually, the drive TFT $\mathbf{53}_{i+1}$, with voltage S2 supplied to the gate, becomes the ON state, but voltage is not applied to the OLED $LD_{i+1}$, and hence the OLED $LD_{i+1}$ does not emit light.

In this state, a potential difference between the data line $X_k$ and the scan line $Yb_{i+1}$, that is, the voltage S2 is written in the capacitor $CS_{i+1}$, as in the capacitor $CS_{i-1}$ in the display cell $PX_{(k, i-1)}$ in the period t0. Even at the time of writing the voltage, as described above, since current does not flow into the write scan line $Yb_{i+1}$ from the OLEDs in the respective display cells, a voltage drop does not occur.

On the other hand, since the select TFTs in the display cells other than the display cell $PX_{(k, i+1)}$ are in the OFF state in the period t2, in the initial state in which electric-charge is not held in the capacitors in these display cells, the respective drive TFTs are in the OFF state, and hence the respective OLEDs do not emit light. However, since the voltage S0 has been written in the capacitor $CS_{i-1}$ in the display cell $PX_{(k, i-1)}$ in the period t0, the drive TFT $\mathbf{53}_{i-1}$ becomes the ON state. Further, since the write scan line $Yb_{i-1}$ indicates a negative supply voltage $-V_{dd}$, the voltage $V_{dd}$ is applied to the OLED $LD_{i-1}$ and hence the OLED $LD_{i-1}$ starts to emit light.

Further, the voltage S1 has been written in the capacitor $CS_i$ in the display cell $PX_{(k, i)}$ in the period t1, the drive TFT $\mathbf{53}_i$ becomes the ON state. However, since the write scan line $Yb_1$ indicates 0[V], voltage is not applied to the OLED $LD_i$, and the OLED $LD_i$ does not emit light.

During the next period t3, the scan line driving circuit 60 supplies the voltage V2 to the select scan line $Ya_{i+2}$, a negative supply voltage $-V_{dd}$ to the select scan lines $Ya_i$ to $Ya_{i+2}$ and other select scan lines (not shown), a negative supply voltage $-V_{dd}$ to write scan lines $Yb_{i-1}$ and $Yb_i$, and grounded potential (0[V]) to the write scan lines $Yb_{i+1}$ and $Yb_{i+2}$ and other write scan lines (not shown). As a result, only the select TFT $\mathbf{52}_{i+2}$ in the display cell $PX_{(k, i+2)}$ becomes the ON state, and the other select TFTs are in the OFF state.

During the period t3, a voltage S3 is supplied to the data line $X_k$ by the data line driving circuit 70. Since the source of the drive TFT $\mathbf{53}_{i+2}$ is connected to the write scan line $Yb_{i+2}$, the potential thereof indicates the potential of the write scan line $Yb_{i+2}$, that is, 0[V]. Therefore, when the select TFT $\mathbf{52}_{i+1}$ becomes the ON state, the source-gate voltage of the drive TFT $\mathbf{53}_{i+2}$, that is, the voltage S3 is input to the gate of the drive TFT $\mathbf{53}_{i+2}$. This state is the same as the state in the display cell $PX_{(k, i-1)}$ in the period t0, and eventually, the drive TFT $\mathbf{53}_{i+2}$, with voltage S3 supplied to the gate, becomes the ON state, but voltage is not applied to the OLED $LD_{i+2}$, and hence the OLED $LD_{i+2}$ does not emit light.

In this state, a potential difference between the data line $X_k$ and the scan line $Yb_{i+2}$, that is, the voltage S3 is written in the capacitor $CS_{i+2}$, as in the capacitor $CS_{i-1}$ in the display cell $PX_{(k, i-1)}$ in the period t0. Even at the time of writing the voltage, as described above, since current does not flow into the write scan line $Yb_{i+2}$ from the OLEDs in the respective display cells, a voltage drop does not occur.

On the other hand, since the select TFTs in the display cells other than the display cell $PX_{(k, i+2)}$ are in the OFF state in the period t3, in the initial state in which electric charge is not held in the capacitors in these display cells, the respective drive TFTs are in the OFF state, and hence the respective OLEDs do not emit light. However, the drive TFT $\mathbf{53}_{i-1}$ becomes the ON state due to the capacitor $CS_i$ in which the voltage S0 has been written. Further, since the write scan line $Yb_{i-1}$ indicates a negative supply voltage $-V_{dd}$, the OLED $LD_{i-1}$ sustains light emission continuously from the period t2.

Further, since the voltage S1 has been written in the capacitor $CS_i$ in the display cell $PX_{(k, i)}$ in the period t1, the drive TFT $\mathbf{53}_i$ becomes the ON state. Since the write scan line $Yb_1$ indicates a negative supply voltage $-V_{dd}$, the OLED $LD_i$ starts to emit light. Since the voltage S2 has been written in the capacitor $CS_{i+1}$ in the display cell $PX_{(k, i+1)}$ in the period t2, the drive TFT $\mathbf{53}_{i+1}$ becomes the ON state. However, since the write scan line $Yb_{i+1}$ indicates 0[V], the OLED $LD_{i+1}$ is not applied with the voltage and does not emit light.

During the next period t4 and onward, these operations are repeated. In other words, the voltage V2 is supplied to the select scan line in the order of selection by the scan line driving circuit 70, and the negative supply voltage $-V_{dd}$ is supplied to the write scan line forming a pair therewith.

In these repetitive operations, the respective display cells operate in a flow having a first phase for writing a data voltage in the capacitor, without allowing the OLED to emit light, with the voltage V2 supplied to the select scan line and $-V_{dd}$ supplied to the write scan line, a second phase for holding the voltage stored in the capacitor without allowing the OLED to emit light, with the voltage 0[V] supplied to the select scan line and $-V_{dd}$ supplied to the write scan line, and a third phase for sustaining the light emission of the OLED until the new first phase, based on the voltage stored in the capacitor, with $-V_{dd}$ supplied to the select scan line and the write scan line. That is, the operation is performed sequentially with respect to the display cell selected by the scan line driving circuit 70. The respective voltages have the following relation:

$$V2>V1>0>-V_{dd}.$$

As explained above, according to the EL display apparatus and the driving method thereof according to the third embodiment, since the voltage provided to the gate of the select TFT and one terminal of the capacitor is sequentially provided with a predetermined relationship, so that the data voltage can be written in the capacitor without allowing the current to flow to the OLED, the potential at one terminal of the capacitor does not change corresponding to the position of the display cell on the line, and hence a desired voltage can be accurately held in the capacitor. In other words, even if the number of the display cells located in the line direction increases due to a large screen size of the active matrix panel 50, such nonuniform luminance, which has heretofore occurred, that it is dark in the central portion and brighter towards the edge does not occur.

The EL display apparatus and the driving method thereof according to a fourth embodiment will be explained below. The EL display apparatus and the driving method thereof according to the fourth embodiment has a feature in that a pulse having a different pattern is input to display cells other than the display cell in which a pulse having the pattern as shown in FIG. 8 is written, to thereby perform data write and data erase at the same time on the same panel.

The schematic configuration of the EL display apparatus according to the fourth embodiment is as shown in FIG. 6, and hence the explanation thereof is omitted. Therefore, the driving method by the scan line driving circuit 60 will be explained below.

Figure 9:
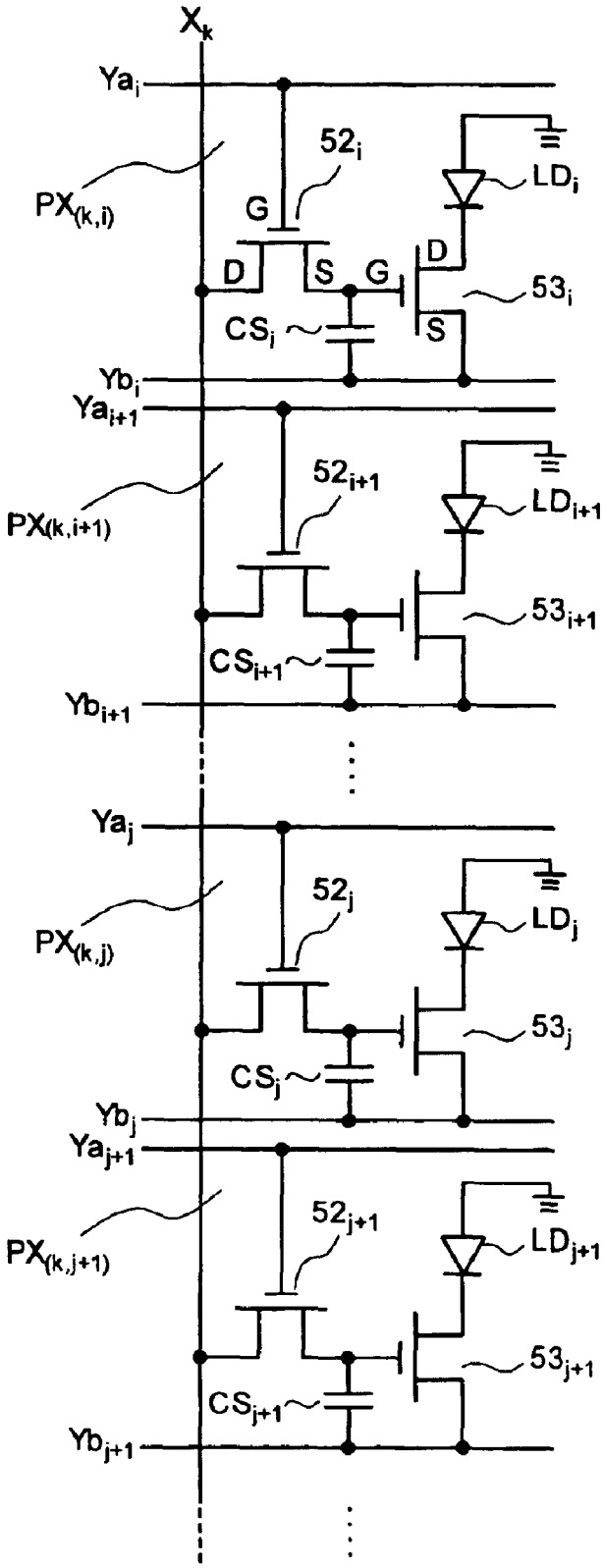
FIG. 9 is an equivalent circuit diagram in a display cell of the EL display apparatus according to the fourth embodiment.

FIG. 9 illustrates an equivalent circuit in the display cell of the EL display apparatus according to the fourth embodiment. Particularly, FIG. 9 indicates two display cells $PX_{(k,\ i)}$ and $PX_{(k,\ i+1)}$ located on the i-th line and the i+1-th line, and two display cells $PX_{(k,\ j)}$ and $PX_{(k,\ j+1)}$ located on the j-th line and the j+1-th line away from these two display cells by predetermined lines, on the k-th row. Since the circuit configuration and the signs in the respective display cells are the same as in the third embodiment, and hence the explanation thereof is omitted.

Figure 10:
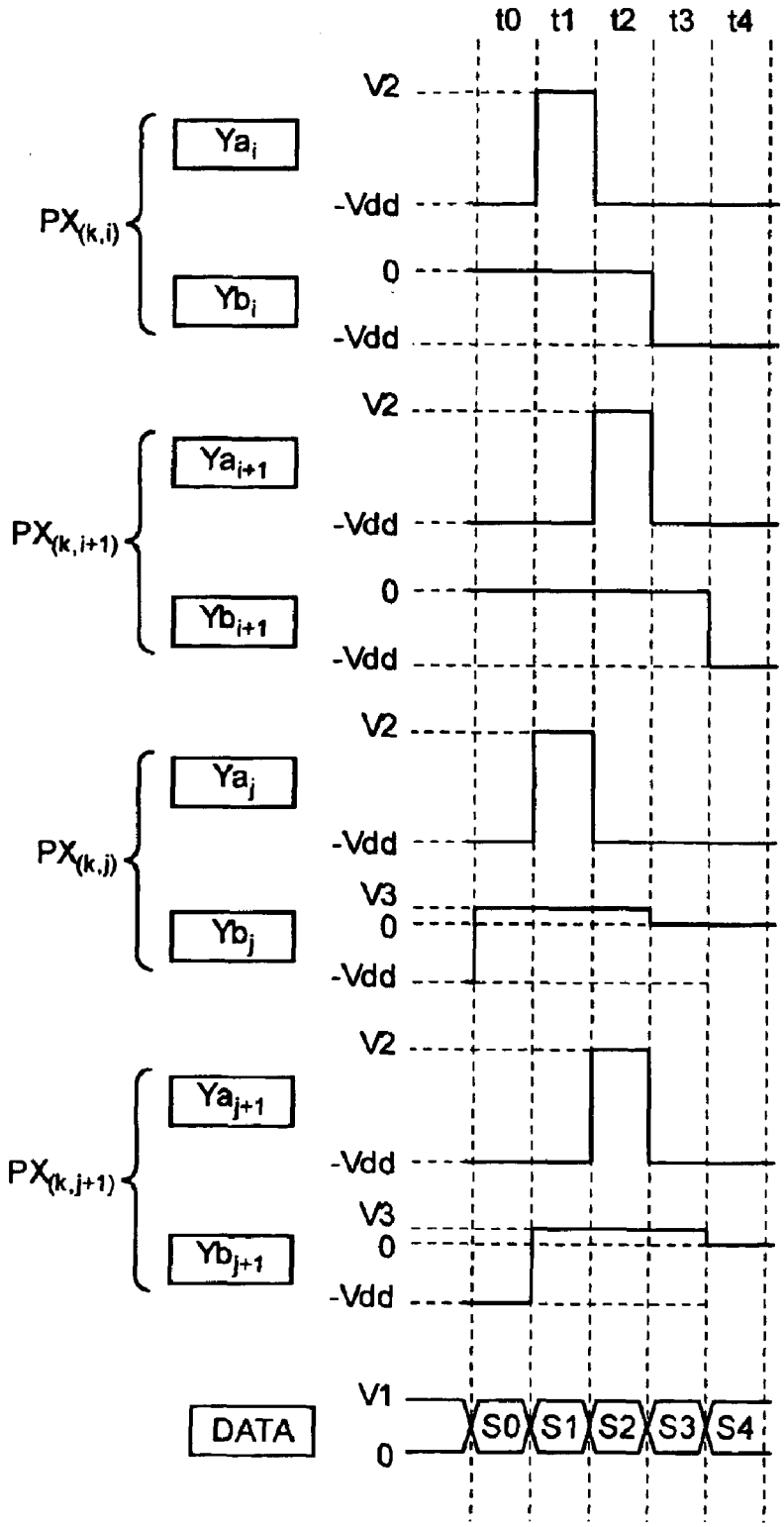
FIG. 10 is a timing chart of a scan line select voltage supplied to a select scan line, a write reference voltage supplied to a write scan line, and a data voltage supplied to a data line, in the equivalent circuit in the display cell in the EL display apparatus.

FIG. 10 illustrates a timing chart of a scan line select voltage supplied to the scan lines $Ya_i$, $Ya_{i+1}$, $Ya_j$, and $Ya_{j+1}$, a write reference voltage supplied to the write scan lines $Yb_i$, $Yb_{i+1}$, $Yb_j$, and $Yb_{j+1}$, and a data voltage supplied to the data line $X_k$, in the equivalent circuit shown in FIG. 9. Voltages V1, V2, and $-V_{dd}$ in the figure have the relation shown in the third embodiment, and the relation between a voltage V3 described later and the voltage V1 is: V3>V1. The operation in the respective periods t0 to t4 for the display cells $PX_{(k,\ i)}$ and $PX_{(k,\ i+1)}$ is the same as that in the respective periods explained in the third embodiment, and hence the explanation thereof is omitted. Only the operation in the display cells $PX_{(k,\ j)}$ and $PX_{(k,\ j+1)}$, in other words, the operation in the display cell to be erased, will be explained.

At first, during the period t0, the scan line driving circuit 60 supplies a negative voltage $-V_{dd}$ to the select scan lines $Ya_i$ and $Ya_{j+1}$, and select scan lines in other display cells to be erased (not shown), a voltage V3 to write scan lines $Yb_j$, and a negative voltage $-V_{dd}$ to the write scan lines $Yb_{j+1}$ and write scan lines in other display cells to be erased (not shown). It is assumed here that the display cells $PX_{(k,j)}$ and $PX_{(k,\ j+1)}$, and other display cells to be erased are in the light emitting state. Therefore, with the supply of the voltage by the scan line driving circuit 60, the respective select TFTs in the display cells $PX_{(k,\ j)}$ and $PX_{(k,\ j+1)}$, and other display cells to be erased (not shown) become the OFF state.

During the period t0, the data voltage S0 is supplied to the data line $X_k$ by the data line driving circuit 70. Since the respective select TFTs in the display cells to be erased are in the OFF state, the capacitors in these display cells are not affected by the voltage S0. On the other hand, since a data voltage has been written in the capacitors in these display cells in other periods, the display cells are to be allowed to emit light or to be erased, according to the state of potential of the write scan line connected to one terminal of the capacitor. In this period t0, since the write scan line $Yb_j$ indicates a voltage V3 larger than the data voltage, the positive voltage written in the capacitor $CS_j$ is discharged to set the drive TFT $\mathbf{53}_j$ in the display cell $PX_{(k,\ j)}$ to the OFF state, and hence the OLED $LD_j$ is turned off. Further, since write scan line $Yb_{j+1}$ indicates a negative supply voltage $-V_{dd}$, the voltage stored in the capacitor $CS_{j+1}$ is provided to the gate of the drive TFT $\mathbf{53}_{j+1}$ in the display cell $PX_{(k,\ j+1)}$, and hence the OLED $LD_j$ sustains light emission.

During the next period t1, the scan line driving circuit 60 supplies the voltage V2 to the select scan line $Ya_j$, a negative supply voltage $-V_{dd}$ to the select scan line $Ya_{j+1}$, and other select scan lines (not shown) in the display cells to be erased, voltage V3 to the write scan lines $Yb_j$ and $Yb_{j+1}$, and the negative supply voltage $-V_{dd}$ to the other write scan lines (not shown) in the display cells to be erased. As a result, the select TFT $\mathbf{52}_j$ in the display cell $PX_{(k,\ j)}$ becomes the ON state, and select TFT $\mathbf{52}_{j+1}$ in the display cell $PX_{(k,\ j+1)}$ becomes the OFF state.

During the period t1, the voltage S1 is supplied to the data line $X_k$ by the data line driving circuit 70. Since the source of the drive TFT $\mathbf{53}_j$ is connected to the write scan line $Yb_j$, the potential thereof indicates the potential of the write scan line $Yb_j$, that is, voltage V3. Therefore, when the select TFT $\mathbf{52}_j$ becomes the ON state, a negative voltage S1-V3 is input to the capacitor $CS_j$ and the gate of the drive TFT $\mathbf{53}_j$. As a result, the drive TFT $\mathbf{53}_j$ becomes the OFF state, and hence the OLED $LD_j$ sustains the light-out state. Further, the negative voltage S1-V3 is written in the capacitor $CS_j$.

On the other hand, since the select TFT $\mathbf{52}_{j+1}$ is in the OFF state, but the write scan line $Yb_{j+1}$ indicates the voltage V3 larger than the data voltage, the positive voltage written in the capacitor $CS_{j+1}$ is discharged, and the drive TFT $\mathbf{53}_{j+1}$ in the display cell $PX_{(k,\ j+1)}$ becomes the OFF state. That is, the OLED $LD_{j+1}$ is turned off.

During the next period t2, the scan line driving circuit 60 supplies the negative supply voltage $-V_{dd}$ to the select scan line $Ya_j$ and other select scan lines (not shown) in the display cells to be erased, voltage V2 to the select scan line $Ya_{j+1}$, voltage V3 to the write scan line $Yb_j$ and $Yb_{j+1}$, and the negative supply voltage $-V_{dd}$ to the other write scan lines (not shown) in the display cells to be erased. As a result, the select TFT $\mathbf{52}_j$ in the display cell $PX_{(k,\ j)}$ becomes the OFF state, and the select TFT $\mathbf{52}_{j+1}$ in the display cell $PX_{(k,\ j+1)}$ becomes the ON state.

During the period t2, the data line driving circuit 70 supplies voltage S2 to the data line $X_k$. Since the source of the drive TFT $\mathbf{53}_{j+1}$ is connected to the write scan line $Yb_{j+1}$, the potential thereof indicates the potential of the write scan line $Yb_{j+1}$, that is, voltage V3. Therefore, when the select TFT $\mathbf{52}_{j+1}$ becomes the ON state, a negative voltage S2-V3 is input to the capacitor $CS_{j+1}$ and the gate of the drive TFT $\mathbf{53}_{j+1}$. As a result, the drive TFT $\mathbf{53}_{j+1}$ becomes the OFF state, and hence the OLED $LD_{j+1}$ sustains the light-out state. Further, the negative voltage S2-V3 is written in the capacitor $CS_{j+1}$.

On the other hand, the select TFT $\mathbf{52}_j$ is in the OFF state, but since the negative voltage S1-V3 has been written in the capacitor $CS_j$ in the period t1, the drive TFT $\mathbf{53}_j$ is still in the OFF state, and the OLED $LD_j$ sustains the light-out state.

During the next period t3, the scan line driving circuit 60 supplies the negative supply voltage $-V_{dd}$ to the select scan lines $Ya_j$, $Ya_{j+1}$, and other select scan lines (not shown) in the display cells to be erased, 0[V] to the write scan lines $Yb_j$, voltage V3 to the write scan line $Yb_{j+1}$, and the negative supply voltage $-V_{dd}$ to the other write scan lines (not shown) in the display cells to be erased. As a result, the select TFT $\mathbf{52}_j$ in the display cell $PX_{(k,\ j)}$ and select TFT $\mathbf{52}_{j+1}$ in the display cell $PX_{(k,\ j+1)}$ both become the OFF state.

During the period t3, the data line driving circuit 70 supplies data voltage S3 to the data line $X_k$. However, since the respective select TFTs in the display cells to be erased are in the OFF stage, the capacitors in these display cells are not affected by the voltage S3. On the other hand, since the negative voltage S1-V3 has been written in the capacitor $CS_j$ in the display cell $PX_{(k,\ j)}$ in the period t1, the drive TFT $\mathbf{53}_j$ is still in the OFF state, and the OLED $LD_j$ sustains the light-out state. Likewise, since the negative voltage S2-V3 has been written in the capacitor $CS_{j+1}$ in the display cell $PX_{(k,\ j+1)}$ in the period t2, the drive TFT $\mathbf{53}_{j+1}$ is still in the OFF state, and the OLED $LD_{j+1}$ sustains the light-out state.

During the next period t4 and onward, similar operations to those described above are repeated sequentially with respect to the respective display cells. In other words, as explained in the third embodiment, the display cells located on a select scan line at a certain position can be made to emit light sequentially, without causing a voltage drop on the select scan line, and data erase is performed sequentially from the display cell located on another select scan line on the same active matrix panel.

As explained above, according to the EL display apparatus and the driving method according to the fourth embodiment, in addition to the driving method explained in the third embodiment, a negative voltage is sequentially written in the capacitors in the display cells on the scan line, in which voltage write for emitting light is not performed. As a result, data display and data erase can be executed at the same time on the active matrix panel 50. Particularly, in the data erase operation, a reverse voltage is applied to between the source and gate of the drive TFT, thereby enabling suppression of a threshold voltage shift in the drive TFT.

Figure 14A:
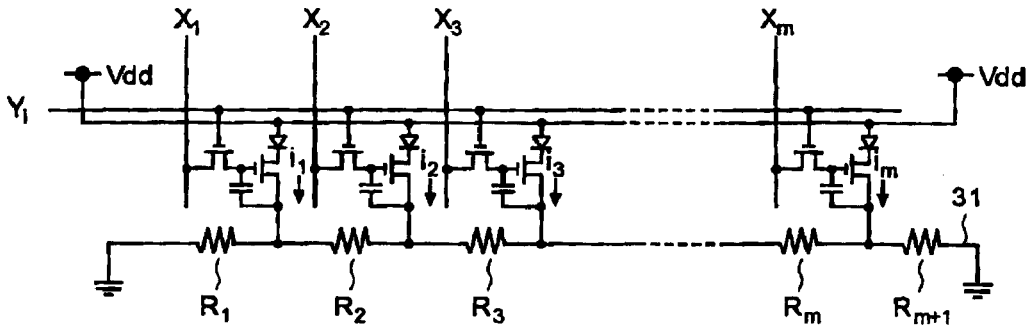
FIG.14A CONVENTIONAL ART
FIG. 14A is an equivalent circuit diagram of a part of a conventional active matrix panel.
Figure 14B:
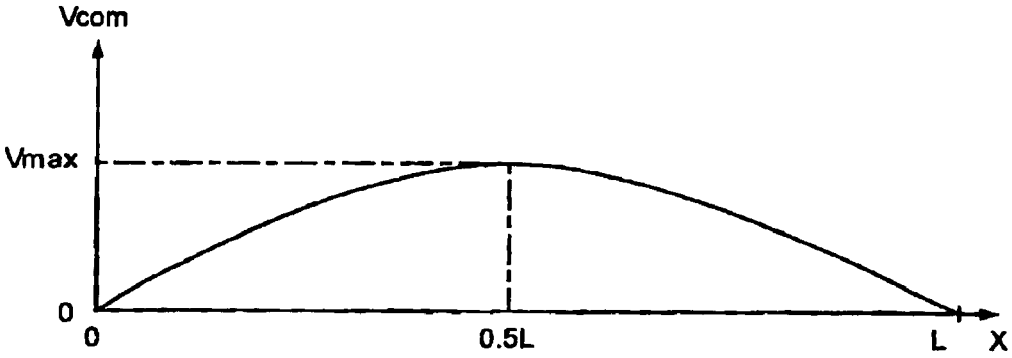
FIG.14B CONVENTIONAL ART
FIG. 14B is a graph indicating a voltage drop in a common line.

The EL display apparatus and the driving method thereof according to a fifth embodiment will be explained below. The EL display apparatus and the driving method thereof according to the fifth embodiment has a feature in that in a conventional configuration having a common line as shown in FIG. 14A, a voltage drop on the common line in the respective display cells is predicted, and the size of the data voltage is adjusted according to the prediction result.

Figure 11A:
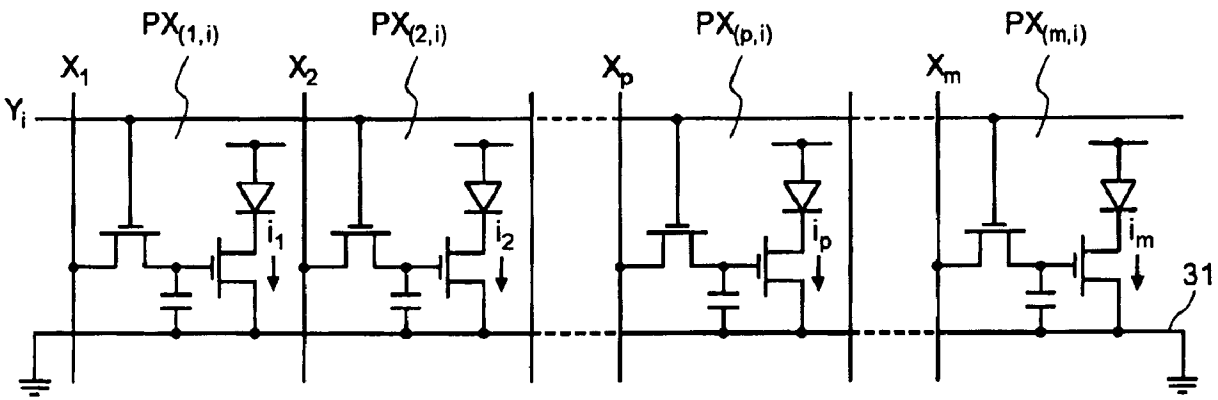
FIG. 11A is an equivalent circuit diagram for explaining a driving method of an EL display apparatus according to a fifth embodiment.
Figure 11B:
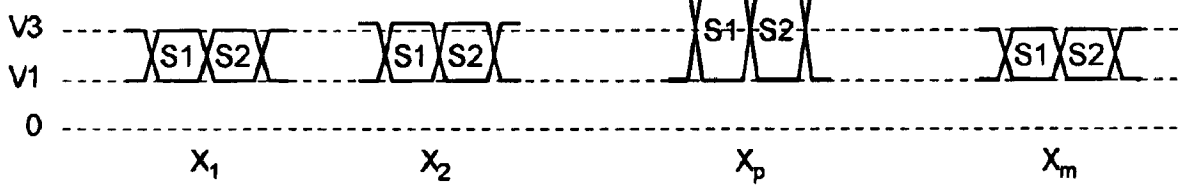
FIG. 11B is a timing chart of the equivalent circuit.

FIG. 11 illustrates a driving method of the EL display apparatus according to the fifth embodiment. Particularly, FIG. 11A indicates a display cell row in the i-th line on the active matrix panel, and FIG. 11B indicates a data voltage supplied to the respective display cells.

If it is assumed that the current flowing from the respective display cells to the common line 31 is $i_1, i_2, \ldots, i_p, \ldots, i_m$, a voltage ($V_{s,\ p}$) obtained by adding a voltage drop between the display cells on the common line 31 up to the p-th pixel from the left of the common line 31 becomes a potential on the common line 31 in the k-th display cell $PX_{(p,\ i)}$, and is expressed by the following equation (1).

$$V_{s,p} = r\sum_{j=1}^{p}\left(\sum_{k=j}^{m} i_{L,k} - \sum_{k=1}^{j-1} i_{R,k}\right) \tag{1}$$

where r refers to a resistance in the wiring resistance between the display cells.

Further, $$i_{L,k} = \frac{n+1-k}{n+1}\cdot i_k,\ i_{R,k} = \frac{k}{n+1}\cdot i_k \tag{2}$$

where $i_{L,\ k}$ refers to the current flowing from the display cell $PX_{(p,\ i)}$ to the left side of the common line 31, and $i_{R,\ k}$ refers to the current flowing from the display cell $PX_{(p,\ i)}$ to the right side of the common line 31.

Therefore, a deviation $\delta V_{ds,\ m}$ of the voltage between the drain-source of the drive TFT when a voltage drop does not occur in the common line 31, that is, the common line 31 is the grounded potential, and when the potential of the common line 31 has eventually risen due to the voltage drop can be expressed as:

$$\delta V_{ds,p} = V'_{ds,p} - V_{ds,p} = (V_{d,p} - V_{s,p}) - (V_{d,p} - 0) = -V_{s,p} \tag{3}$$

where $V_{d,\ p}$ refers to the drain potential of the drive TFT, and $V_{s,\ p}$ refers to the source potential of the drive TFT.

In other words, a voltage less than the original voltage by the deviation $\delta V_{ds,\ m}$ is applied to the OLEDs in the respective display cells, and as a result, the current flowing to the OLEDs decreases to decrease the luminance. Therefore, if a voltage $V'_{gs}$, in which the decrease of the voltage is compensated, (hereinafter, "compensated voltage") is applied to the gate of the drive TFT instead of the original voltage $V_{gs}$, a decrease in luminance of the OLEDs due to the voltage drop can be compensated. Here, if a decrease in the applied voltage to the OLED is designated as $\delta V_{ds}$, a conductance of the drive TFT is designated as $g_m$, and an output resistance is designated as $r_D$, a change in the current ($\delta I_{ds}$) flowing to the drive TFT can be expressed by the following equation (4):

$$\delta I_{ds} = \frac{\partial I_{ds}}{\partial V_{gs}}\delta V_{gs} + \frac{\partial I_{ds}}{\partial V_{ds}}\delta V_{ds} = g_m\cdot\delta V_{gs} + \frac{1}{r_D}\delta V_{ds} \tag{4}$$

Therefore, from $\delta I_{ds}=0$, it can be expressed as:

$$\delta V_{gs} = -\frac{1}{r_D\cdot g_m}\cdot\delta V_{ds} \tag{5}$$

Here, if the original voltage provided to the gate of the drive TFT in the display cell $PX_{(p,\ i)}$ is designated as $V_{gs,\ p}$, and the compensated voltage is designated as $V'_{gs,\ p}$, the compensated voltage can be expressed as:

$$\begin{aligned} V'_{gs,p} &= V_{gs,p} + \delta V_{gs,p} = V_{gs,p} - \frac{\delta V_{ds,p}}{r_D\cdot g_m} \\ &= V_{gs,p} + \frac{r}{r_D\cdot g_m}\sum_{j=1}^{p}\left(\sum_{k=j}^{m} i_{L,k} - \sum_{k=1}^{j-1} i_{R,k}\right) \end{aligned} \tag{6}$$

Therefore, if the data voltage is increased so that the data line driving circuit can provide the compensated voltage $V'_{gs,\ p}$ to the gate of the drive TFT in the display cell $PX_{(p,\ i)}$, light emission of a desired luminance can be obtained. The compensated voltage can be respectively obtained for the respective display cells other than the display cell $PX_{(p,\ i)}$, by making p correspond to the row position of the display cell, in the equation (6). In other words, by adjusting the data voltage based on the compensated voltage provided by the equation (6), as shown in FIG. 11B, the data line driving circuit can make the OLEDs in the display cells over the whole line emit light at a desired luminance.

As explained above, according to the EL display apparatus and the driving method thereof according to the fifth embodiment, in the configuration of the conventional active matrix panel having the common line, the compensated voltage for compensating a drop in the applied voltage to the respective OLEDs resulting from a voltage drop on the common line is anticipated, and the data line driving circuit adjusts the size of the data voltage based on the anticipated value. As a result, even if the number of display cells located in the line direction increases due to a large screen size of the active matrix panel, such nonuniform luminance, which has heretofore occurred, that it is dark in the central portion and brighter towards the edge does not occur.

Figure 12:
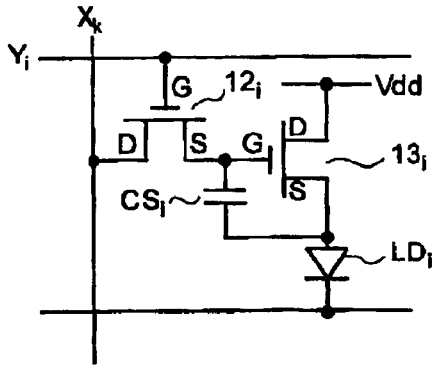
FIG. 12 is an equivalent circuit in a replaceable cathode common type display cell in the first to the fifth embodiments.

In the first to the fifth embodiments, a so-called anode common type display cell, in which the supply line of the supply voltage $V_{dd}$ is connected to the anode side of the OLED, is shown, but as shown in FIG. 12, the same effects can be obtained by adopting a so-called cathode common type display cell, in which the scan line or the common line is connected to the cathode side of the OLED.

Further, in the first to the fifth embodiments, an OLED has been mentioned as the self-luminescent element, but instead of the OLED, the same effects can be obtained even when other electroluminescent devices such as an inorganic LED or a light emitting diode is used.

According to the EL display apparatus and the driving method thereof according to the present invention, since one terminal of the capacitor and the source of the drive transistor are connected to the scan line for selecting a low-order line in the display cell including these, the common line, which has been heretofore necessary, can be eliminated. Further, since the data voltage is written in the capacitor, with the potential at one terminal of the capacitor in the display cell fixed to voltage V1, which is input to the scan line, and with no current allowed to flow to the electroluminescent device. Therefore, the potential at one terminal of the capacitor does not change according to the position of the display cell on the line, and a desired voltage can be accurately held in the capacitor.

According to the EL display apparatus and the driving method thereof according to the present invention, in addition to the effect of the above invention, there is the effect that a negative voltage is written sequentially to the capacitor in the display cell on the scan line, where voltage write for emitting light is not performed, and hence data display and data erase can be executed at the same time on the active matrix panel.

According to the EL display apparatus and the driving method thereof according to the present invention, since the data voltage is written in the capacitor in the respective display cells, with the capacitor fixed to a predetermined potential by the write scan line independent from the select scan line for driving the select transistor, without allowing the current to flow to the electroluminescent device, the potential at one terminal of the capacitor does not change corresponding to the position of the display cell on the line, and hence a desired voltage can be accurately held in the capacitor.

According to the EL display apparatus and the driving method thereof according to the present invention, in addition to the effect of the above invention, there is the effect that a negative voltage is sequentially written in the capacitors in the display cells on the write scan line, in which voltage write for emitting light is not performed, and hence data display and data erase can be executed at the same time on the active matrix panel.

According to the EL display apparatus and the driving method thereof according to the present invention, in the configuration of the conventional active matrix panel having the common line, the compensated voltage for compensating a drop in the applied voltage to the respective electroluminescent devices resulting from a voltage drop on the common line is anticipated, and the data line driving circuit adjusts the size of the data voltage based on the anticipated value. As a result, there is the effect that even if the number of display cells located in the line direction increases due to a large screen size of the active matrix panel, such nonuniform luminance, which has heretofore occurred, that it is dark in the central portion and brighter towards the edge does not occur.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. An electroluminescent display apparatus, comprising:

a plurality of display cells arranged in a matrix form in which a plurality of scan lines and a plurality of data lines intersect, wherein each of the display cells includes a select transistor whose gate receives a select voltage from one of the scan lines, a drive transistor whose gate receives a data voltage from one of the data lines through the select transistor, a capacitor whose one terminal is connected to the gate of the drive transistor, and an electroluminescent element whose one terminal is connected to one of a source and a drain of the drive transistor, and a scan line driving circuit that supplies a stepped pulse as the select voltage to each of the scan lines, the stepped pulse being formed of a first voltage and a second voltage larger than the first voltage, wherein the other of the source and the drain of the drive transistor and the other terminal of the capacitor are connected to a scan line next to the one of the scan lines.

2. The electroluminescent display apparatus according to claim 1, wherein the stepped pulse is formed so that the first voltage is allocated on a former of two cycles and the second voltage is allocated on a later of the two cycles, and the scan line driving circuit supplies the stepped pulse sequentially to the scan lines by shifting the stepped pulse by one cycle.

3. The electroluminescent display apparatus according to claim 2, wherein the scan line driving circuit further supplies a rectangular pulse to a scan line different from the scan line to which the stepped pulse is being supplied, and the rectangular pulse is formed of a third voltage having a pulse width of the stepped pulse.

4. The electroluminescent display apparatus according to claim 3, wherein the third voltage is equal to the second voltage.

5. The electroluminescent display apparatus according to claim 1, wherein the scan line driving circuit further supplies a rectangular pulse to a scan line different from the scan line to which the stepped pulse is being supplied, sequentially by shifting the stepped pulse by one cycle, and the rectangular pulse is formed of a third voltage having a pulse width of the stepped pulse.

6. The electroluminescent display apparatus according to claim 5, wherein the third voltage is equal to the second voltage.

7. The electroluminescent display apparatus according to claim 1, further comprising a data line driving circuit that supplies a data voltage to each of the data lines, the data voltage being not smaller than the first voltage and smaller than the second voltage.

8. The electroluminescent display apparatus according to claim 1, wherein the electroluminescent element is an organic light emitting diode.

9. An electroluminescent display apparatus, comprising:

a plurality of display cells arranged in a matrix form in which a plurality of select scan lines and a plurality of data lines intersect, wherein each of the display cells includes a select transistor whose gate receives a select voltage from one of the select scan lines, a drive transistor whose gate receives a data voltage from one of the data lines through the select transistor, a capacitor whose one terminal is connected to the gate of the drive transistor, and an electroluminescent element whose one terminal is connected to one of a source and a drain of the drive transistor;

a plurality of write scan lines, each of the write scan lines being arranged in a pair with each of the select scan lines and being connected to the other of the source and the drain of the drive transistor and the other terminal of the capacitor; and a scan line driving circuit that supplies a scan line select voltage to each of the select scan lines, and that supplies a write reference voltage to each of the write scan lines that is in a pair with the each of the select scan lines, wherein the scan line driving circuit supplies the scan line select voltage and the write reference voltage at a voltage value and a timing such that a first phase, a second phase, and a third phase are sequentially repeated, the first phase indicates that the data voltage is written in the capacitor without allowing the electroluminescent element to emit light, the second phase indicates that a voltage stored in the capacitor is held without allowing the electroluminescent element to emit light, and the third phase indicates that light emission by the electroluminescent element is sustained until a next first phase depending on the voltage stored.

10. The electroluminescent display apparatus according to claim 9, wherein the scan line driving circuit supplies the scan line select voltage and the write reference voltage with respect to each of the select scan lines and each of the write scan lines, at a voltage value and a timing such that a negative voltage is supplied to the capacitor, concurrently with the first, the second, and the third phases, and the each of the select scan lines and the each of the write scan lines are different from the select scan line and the write scan line that are under the first, the second, and the third phases.

11. The electroluminescent display apparatus according to claim 9, wherein the electroluminescent element is an organic light emitting diode.

12. An electroluminescent display apparatus, comprising:

a plurality of display cells arranged in a matrix form in which a plurality of scan lines and a plurality of data lines intersect, wherein each of the display cells includes a select transistor whose gate receives a select voltage from one of the scan lines, a drive transistor whose gate receives a data voltage from one of the data lines through the select transistor, a capacitor whose one terminal is connected to the gate of the drive transistor, and an electroluminescent element whose one terminal is connected to one of a source and a drain of the drive transistor;

a plurality of common lines, each of the common lines being connected to the other of the source and the drain of the drive transistor and other terminal of the capacitor; and a data line driving circuit that calculates a voltage drop in the electroluminescent element at a position in a direction of each of the scan lines, based on the position in the direction with respect to the each of common lines and a wiring resistance between the display cells arranged on the each of common lines, and that supplies a data voltage corrected based on the voltage drop to each of data lines.

13. The electroluminescent display apparatus according to claim 12, wherein the electroluminescent element is an organic light emitting diode.

14. A driving method of an electroluminescent display apparatus that includes a plurality of display cells arranged in a matrix form in which a plurality of scan lines and a plurality of data lines intersect, wherein each of the display cells includes a select transistor whose gate receives a select voltage from one of the scan lines, a drive transistor whose gate receives a data voltage from one of the data lines through the select transistor, a capacitor whose one terminal is connected to the gate of the drive transistor, and an electroluminescent element whose one terminal is connected to one of a source and a drain of the drive transistor, wherein the other of the source and the drain of the drive transistor and other terminal of the capacitor are connected to a scan line next to the one of the scan lines, the driving method comprising:

supplying a select-on voltage to a scan line during a time period;

supplying a select-maintain voltage larger than the select-on voltage to the scan line and the select-on voltage to a next scan line during a subsequent time period;

supplying a select-off voltage not larger than a threshold voltage of the select transistor to the scan lines other than the scan line and the next scan line during the time period and the subsequent time period, wherein supplying the select-on voltage, the select-maintain voltage, and the select-off voltage shifts to the next scan line during the subsequent time period.

15. The driving method according to claim 14, further comprising:

supplying an erase voltage to another scan line during the time period, another scan line being different from the scan line and the next scan line, supplying the erase voltage to a next another scan line during the subsequent time period while maintaining the erase voltage to the another scan line, wherein the select-off is applied to scan lines other than the scan line, the next scan line, the another scan line, and the next another scan line during the time period and the subsequent time period.

16. A driving method of an electroluminescent display apparatus that includes a plurality of display cells arranged in a matrix form in which a plurality of select scan lines and a plurality of data lines intersect, wherein each of the display cells includes a select transistor whose gate receives a select voltage from one of the select scan lines, a drive transistor whose gate receives a data voltage from one of the data lines through the select transistor, a capacitor whose one terminal is connected to the gate of the drive transistor, and an electroluminescent element whose one terminal is connected to one of a source and a drain of the drive transistor, and a plurality of write scan lines, each of the write scan lines being arranged in a pair with each of the select scan lines and being connected to the other of the source and the drain of the drive transistor and other terminal of the capacitor, the driving method comprising:

first supplying the select voltage and a write reference voltage to each of the select scans line and each of the corresponding write scan lines, respectively, at a voltage value and a timing such that the data voltage is written in the capacitor, without allowing the electroluminescent element to emit light;

second supplying the select voltage and the write reference voltage to the each of the select scan lines and the each of the corresponding write scan lines, respectively, at a voltage value and a timing such that a voltage stored in the capacitor is held, without allowing the electroluminescent element to emit light; and third supplying the select voltage and the write reference voltage to the each of the select scan lines and the each of the corresponding write scan lines, respectively, at a voltage value and a timing such that light emission of the electroluminescent device is sustained until the next first supplying, based on the voltage stored in the capacitor.

17. The driving method according to claim 16, further comprising fourth supplying the select voltage and the write reference voltage to the each of the select scan lines and the each of the corresponding write scan lines, respectively, different from the select scan line and the corresponding write scan line to which the first supplying, the second supplying, and the third supplying are being applied, at a voltage value and a timing such that a negative voltage is supplied to the capacitor, concurrently with the first supplying, the second supplying, and the third supplying.

18. A driving method of an electroluminescent display apparatus that includes a plurality of display cells arranged in a matrix form in which a plurality of scan lines and a plurality of data lines intersect, wherein each of the display cells includes a select transistor whose gate receives a select voltage from one of the scan lines, a drive transistor whose gate receives a data voltage from one of the data lines through the select transistor, a capacitor whose one terminal is connected to the gate of the drive transistor, and an electroluminescent element whose one terminal is connected to one of a source and a drain of the drive transistor, and a plurality of common lines, each of the common lines being connected to the other of the source and the drain of the drive transistor and the other terminal of the capacitor, the driving method comprising:

calculating a voltage drop in the electroluminescent element at a position in a direction of each of the scan lines, based on the position in the direction with respect to the each of common lines and a wiring resistance between the display cells arranged on the each of common lines;

correcting the data voltage based on the voltage drop; and supplying the data voltage corrected to each of the data lines.

19. A display cell for a display apparatus, comprising:

a select transistor having a gate electrically connected to a select scan line;

a drive transistor having a gate electrically connected to a data line through the select transistor, a first controlled terminal electrically connected to a supply line, and a second controlled terminal be electrically connected to a write scan line corresponding to the select scan line;

a capacitor having a first terminal electrically connected to the gate of the drive transistor and a second terminal electrically connected the write scan line; and a display element electrically connected either in between the supply line and the first controlled terminal of the drive transistor or in between the write scan line and the second controlled terminal of the drive transistor.

20. The display cell of claim 19, wherein if the display element is electrically connected in between the write scan line and the second controlled terminal of the drive transistor, the display element is also electrically connected in between the write scan line and the second terminal of the capacitor.

21. The display cell of claim 20, wherein the display element is an organic light emitting diode.

22. The display cell of claim 20, wherein the first controlled terminal of the drive transistor is one of a source and a drain and the second controlled terminal is the other of the source and the drain.

23. The display cell of claim 20, wherein the supply line is connected to ground potential.

24. The display cell of claim 20, wherein the select scan line is a scan line for a current row of display cells and the write scan line is a scan line for the next row of display cells.

25. The display cell of claim 24, wherein the first controlled terminal of the drive transistor is one of a source and a drain and the second controlled terminal is the other of the source and the drain.

26. The display cell of claim 24, wherein the supply line is connected to a positive potential Vdd.

* * * * *